US006088942A

United States Patent [19]

Brooks et al.

[11] Patent Number: 6,088,942

[45] Date of Patent: Jul. 18, 2000

[54] METHOD AND APPARATUS FOR RETAINING FLEXIBLE MATERIAL IN A SIGN SYSTEM

[75] Inventors: Gordon L. Brooks, Fort Collins; Jackson R. Brooks, Windsor; Brian D. Brooks, Fort Collins, all of Colo.

[73] Assignee: ABC Sign Products, Inc., Fort Collins, Colo.

[21] Appl. No.: 08/839,390

[22] Filed: Apr. 11, 1997

[51] Int. Cl.[7] ..... G09F 17/00

[52] U.S. Cl. ..... 40/603; 160/328

[58] Field of Search ..... 40/574, 575, 603, 40/604, 792, 793, 794; 160/328, 378; 38/102, 102.1, 102.91

[56] References Cited

U.S. PATENT DOCUMENTS

| | | | |
|---|---|---|---|
| D. 285,456 | 9/1986 | Wiens | D20/39 |
| D. 309,351 | 7/1990 | Patsy | D25/119 |
| D. 373,387 | 9/1996 | Wu | D20/10 |
| 885,726 | 4/1908 | Conklin . | |
| 1,148,764 | 8/1915 | Faires . | |
| 1,192,838 | 8/1916 | Abel . | |
| 1,484,231 | 2/1924 | Pistocco . | |
| 1,535,408 | 4/1925 | Fricke . | |
| 1,554,858 | 9/1925 | Kopp . | |
| 1,686,615 | 10/1928 | Balnojan . | |
| 1,844,967 | 2/1932 | Le Gore . | |
| 1,882,454 | 10/1932 | Spalding . | |
| 1,909,109 | 5/1933 | Kopfstein . | |
| 2,029,221 | 1/1936 | Burgess et al. . | |
| 2,127,060 | 8/1938 | Hansen et al. . | |
| 2,378,163 | 6/1945 | Thomas . | |
| 2,554,542 | 5/1951 | Rust et al. | 160/328 |
| 2,573,318 | 10/1951 | Dow . | |
| 2,645,540 | 7/1953 | Trimble et al. . | |
| 2,705,997 | 4/1955 | Lang | 160/328 |
| 2,751,001 | 6/1956 | Lang | 160/328 |
| 2,882,633 | 4/1959 | Howell . | |
| 2,897,889 | 8/1959 | Kessler . | |
| 2,979,842 | 4/1961 | De Ridder . | |
| 3,013,475 | 12/1961 | Spangler . | |
| 3,143,165 | 8/1964 | Lewis et al. . | |
| 3,273,497 | 9/1966 | Rosema et al. | 160/378 X |
| 3,310,901 | 3/1967 | Sarkisian . | |
| 3,591,940 | 7/1971 | Slemmons . | |
| 3,665,459 | 5/1972 | Dupree et al. . | |
| 3,696,857 | 10/1972 | Le Tarte . | |
| 3,748,455 | 7/1973 | Welton . | |

(List continued on next page.)

OTHER PUBLICATIONS

"Use of ABC Extrusion Company Clips for Panaflex® Sign Faces", (Supplement to Panaflex® Sign Face Worksheet).

EC Frame Systems Manual, EC–Flex System, Standard/Retro–fit Frame Hinged Frame.

Patent Joernaal, Jun. 1996, p. 271.

3M Panaflex™ "Scrimless Sign Face Substrate 600/645 G.P.S.", Product Bulletin 600/645 dated Jun., 1996.

*Primary Examiner*—Brian K. Green

*Attorney, Agent, or Firm*—Santangelo Law Offices, P.C.

[57] ABSTRACT

A retention system for applying tension to a flexible sheet of material used in a sign system is shown. A support frame can be utilized to couple a material retainer which engages the flexible sheet of material. A tensioning member can be utilized to urge the material retainer into a tensioned position on the support frame. A coupling can be used to couple the tensioning member to the support frame and to allow the tensioning member to rotate about the axis of the hinged coupling, such as through a ball and socket arrangement. A spring arm integral to the support frame can be used to retain the tensioning member against the material retainer as well as to retain the material retainer against the support frame. An audible indication can be produced in establishing the tensioning member in its initial position as well as in establishing the material retainer in the tensioned position. A material retainer using an adhesive surface is disclosed for positioning the flexible sheet of material on this material retainer. In addition, a second material retainer which utilizes two interlocking members to retain the flexible sheet of material is disclosed.

70 Claims, 14 Drawing Sheets

U.S. PATENT DOCUMENTS 3,758,972 9/1973 Egermayer .
3,885,335 5/1975 Egermayer .
3,934,365 1/1976 Stein et al. .
3,978,905 9/1976 de Lama et al. .
3,982,345 9/1976 Coleman .
4,007,552 2/1977 Brooks .
4,041,861 8/1977 Alter .
4,107,826 8/1978 Tysdal .
4,131,111 12/1978 Hopper .
4,161,977 7/1979 Baslow .
4,169,327 10/1979 Stilling .
4,188,764 2/1980 Gode .
4,194,312 3/1980 Connors et al. .
4,213,493 7/1980 Haworth .
4,237,632 12/1980 Segerstad .
4,265,039 5/1981 Brooks .
4,317,302 3/1982 Von De Linde .
4,327,513 5/1982 de Gunzburg .
4,348,826 9/1982 Reim .
4,380,880 4/1983 Gandy .
4,403,642 9/1983 Morris ..... 160/328 X
4,404,962 9/1983 Zinn et al. ..... 160/378 X
4,422,253 12/1983 Babberi .
4,424,637 1/1984 Leahy .
4,430,819 2/1984 Chandler .
4,452,000 6/1984 Gandy .
4,453,585 6/1984 Ruggeberg, Sr. et al. .
4,512,098 4/1985 Ready et al. .
4,516,343 5/1985 Stilling .
4,523,400 6/1985 Seely .
4,542,605 9/1985 Gandy .
4,554,754 11/1985 Stilling .
4,580,361 4/1986 Hillstrom et al. .
4,665,671 5/1987 Sarvis .
4,674,213 6/1987 Keithley .
4,674,214 6/1987 Gandy .
4,754,566 7/1988 Gordon .
4,756,107 7/1988 Hillstrom .
4,773,174 9/1988 Boeniger et al. .
4,782,610 11/1988 Hillsbrom et al. .
4,800,947 1/1989 Loomis .
4,802,296 2/1989 Kovalak .
4,817,317 4/1989 Kovalak .
4,817,655 4/1989 Brooks .
4,823,533 4/1989 Hillstrom .
4,862,615 9/1989 Hillstrom .
4,864,756 9/1989 Rasmussen .
4,865,066 9/1989 Brooks .
4,894,960 1/1990 Hill et al. .
4,905,390 3/1990 Stilling .
4,912,900 4/1990 Yeamans .
4,913,312 4/1990 Boutin .
4,922,988 5/1990 Loomis .
4,937,959 7/1990 Palmer et al. .
4,945,936 8/1990 Surrendi .
4,958,458 9/1990 Hillstrom et al. .
4,959,916 10/1990 Cochrane .
4,993,982 2/1991 Knapp .
5,020,252 6/1991 De Boef .
5,020,254 6/1991 Sheppard .
5,025,604 6/1991 Yeamans .
5,040,586 8/1991 Hillstrom .
5,044,102 9/1991 Finch et al. .
5,046,274 9/1991 David .
5,046,545 9/1991 Loomis et al. .
5,076,736 12/1991 Grewe et al. .
5,079,860 1/1992 Nugent .
5,090,145 2/1992 Chiang et al. .
5,099,590 3/1992 Yamaguchi .
5,130,846 7/1992 Kowalchuk .
5,142,804 9/1992 Hillstrom et al. .
5,154,026 10/1992 Strobl, Jr. et al. .
5,159,770 11/1992 Yamaguchi .
5,185,972 2/1993 Markiewicz .
5,188,453 2/1993 Subisak et al. .
5,224,306 7/1993 Cramer .
5,237,785 8/1993 Lukes .
5,239,765 8/1993 Opdahl .
5,242,004 9/1993 Stilling .
5,245,774 9/1993 Huber .
5,255,466 10/1993 Synder ..... 40/603
5,307,575 5/1994 Ivansson et al. .
5,333,425 8/1994 Nickerson et al. .
5,349,772 9/1994 Pardue .
5,381,324 1/1995 Hillstrom et al. .
5,398,388 3/1995 Coleman .
5,408,770 4/1995 Suzuki .
5,408,774 4/1995 Grewe et al. .
5,444,931 8/1995 Hillstrom .
5,450,058 9/1995 Collier .
5,467,546 11/1995 Kovalak .
5,469,672 11/1995 Fisher .
5,507,109 4/1996 Rinzler .
5,517,779 5/1996 Coleman .
5,535,560 7/1996 Fligg .
5,537,302 7/1996 Hillstrom et al. .
5,555,659 9/1996 Hade .
5,570,525 11/1996 Paglieri et al. .
5,572,821 11/1996 Coleman .
5,577,352 11/1996 Fisher .
5,581,966 12/1996 Fligg .
5,608,980 3/1997 Pangeri .
5,735,069 4/1998 Gearing ..... 40/793

METHOD AND APPARATUS FOR RETAINING FLEXIBLE MATERIAL IN A SIGN SYSTEM

BACKGROUND

The present invention relates generally to the field of sign systems, specifically, supporting and tensioning flexible sheets of material in a support frame used in sign systems. In the past, it has been a very time consuming process to mount a flexible sheet of material, such as a translucent sign backing or an actual sign face, to the support frame of a sign. As a result of the added labor involved, the process has been more expensive than one would desire. This time consuming process results in part from the fact that prior sign systems have utilized mounting and tensioning systems which require many mechanical attachments in order to attach the sign face or flexible material to the frame support. As a result, it is a time consuming process to individually connect each individual fastener to the sign face or to connect each and every fastener to the support frame. Furthermore, tensioning these individual fasteners to properly mount the sign in a tensioned position is a time consuming process. A tensioned position is a critical feature in mounting a flexible sign face material as such tensioning is necessary to present a smooth face which has a pleasing visual appearance. As a result, there is a substantial need for a mounting or tensioning system that can be used by an individual to quickly and efficiently mount a sign face to a support frame.

Another aspect of prior installation systems and techniques is the fact that they have typically required a deep section of the frame or a wide frame border to hide the tensioning devices. Since the cost of these types of sign systems is directly related to the cost of the material used to produce them, a tensioning system that uses less material, such as less extruded aluminum, to make the sign is desirable. Furthermore, a system that can provide tensioning without the need for a deep body or wide frame exterior is simply desirable for the obvious reasons of permitting installation in a greater variety of locations and providing a more pleasing appearance of the sign frame. The present invention provides a solution to this problem as will be described below.

Prior mounting systems that have been utilized to mount flexible sheets of material to sign frame supports have often required that the installer have specially designed tools to complete the installation or removal of the sign from the frame support. This again is an expensive aspect of prior systems and highlights the need for a mounting and tensioning system that does not require expensive tools. Therefore, there is a need for a mounting and tensioning system that can be accomplished by hand rather than by the use of specialized tools.

Prior systems have often involved a system where the sign face or flexible sheet of material is attached to a portion of the support frame as the initial step in mounting the sign. In bad weather, in a crowded restaurant, or on a busy street, this can be quite difficult and frustrating. Therefore, there is a need for a system that allows one to quickly and easily install the sign system at the sign display itself. Specifically, there is a need for a tensioning system that can be easily installed into a pre-tensioned position on the sign support frame.

With the recent development of a new material manufactured by 3M, the PANAFLEX™ 600/645 GPS Series, there is now a need for a tensioning system that can properly tension this new material. This material is of a type that does not have a scrim material in the middle layer of the substrate. Consequently, it provides a pleasing appearance for close viewing; but, it also requires precise tensioning to prevent over-tensioning of the weaker substrate. Prior tensioning systems have been rough tensioning systems that are not adapted for providing this required precise tension; therefore, there is quite a need for a tensioning system that can be used with this new type of sign display material as well as other materials that are sensitive to over-tensioning.

One aspect of prior sign installation technique has been to mount the flexible material while at the sign support frame itself. This often must be accomplished near busy traffic, in the middle of a crowded store, or in bad weather. Consequently, there is a need for a mounting system that minimizes the amount of time that a laborer must spend at the support frame in addition to minimizing labor costs. Therefore, there is a need for a system that permits a quick change out of the materials when the user is at the support system itself.

It is also important that the user be able to knowingly install the sign and feel comfortable in the fact that the tensioning is being applied properly. Prior systems have not adequately indicated to a user when the user has properly mounted a tensioning spring or clip in its proper position. Therefore, a need exists for a system that will appropriately indicate to the user that the mechanical elements of the system have been properly installed and that the tensioning system has been properly applied.

One aspect of prior installation techniques has been the absence of a system that gives an audible feedback to the user to notify the user that the flexible sheet of material is being installed properly. Therefore, there is a need for a system that will tell the user as the user installs the flexible sheet of material that the user is accomplishing the installation correctly.

As noted earlier, the quick or easy switchout of a flexible sheet of material has been a problem in many past systems. Therefore, there is a need for a system that is quickly releasable from the support frame in order to accomplish a quick and easy switchout of the sign from the support frame. In past systems, it has been common to apply a translucent backing material, which could be used as a light diffuser, to the sign frame via one support system and to apply the actual signage to the support frame via a second support system. This results in added cost to the system and also results in added weight to the overall support frame. Consequently, there is a need for a system that can not only provide a tensioning of a backing material, but also that can support a sign, such as a poster or transparency film, with the same mechanism. Similarly there is a need with this system to retain the tensioned backing material while allowing an old sign to be switched out and replaced with a new sign or graphics.

Prior sign systems have utilized fasteners, springs, and mechanical clips in order to support the material installed within the sign support. Many of these systems have suffered from the fact that they can damage the sign, they are difficult to apply to the signs, or they are difficult to use to apply tension to the sign, especially uniform tension. Consequently, there is a need for new retainers that can engage flexible sheet of material without causing such damage. Furthermore, there is a need for retainers that can establish the flexible sheet of material in a tensioned position quickly and efficiently, especially a precisely tensioned position.

For the foregoing reasons, there is a need in the industry for a tensioning and retaining system to be used in sign supports that will quickly, easily, and efficiently allow a user to install a flexible sheet of material to a support frame. While the earlier systems have tried to accomplish this, they have failed to provide as simple a solution as that provided by the present invention. Therefore, the present invention satisfies the long felt need for this solution. Furthermore, it highlights the fact that this solution was unseen by those of ordinary skill practicing in this art until the inventors conceived of the invention. This is highlighted by the fact that the manufacturing and labor cost issues involved in this industry have called for a simpler solution to the tensioning of flexible sheets of material without the success of the prior invention.

Naturally, further objects of the invention are disclosed throughout other areas of the specification and claims.

SUMMARY

The present invention is directed towards a retention system for use in sign systems in order to retain flexible sheets of material to a support frame. Furthermore, one embodiment of the invention provides a tensioning system that allows a user to quickly and efficiently tension the flexible sheet of material. A retention system having features of the present invention can comprise a support frame configured to support the flexible sheet of material, a material retainer for engaging the flexible sheet of material independent from the support frame, a coupling which couples a tensioning member to the support frame, and the tensioning member itself which can be used by a sign installer to move the material retainer into a secured position with the support frame. In this fashion, the apparatus allows the user to not only secure the flexible sheet of material to the support frame, but also to apply a proper amount of tension for material that is sensitive to being over-tensioned. The proper amount of tension can also ensure that the flexible sheet of material is not under-tensioned. Furthermore, the system can be configured to provide a covering of the interior frame of the support system or of the material retainer used to engage the flexible sheet of material. The material retainer itself is capable of retaining the flexible sheet of material independently from the support frame. For example, a material retainer might be used to grasp or clamp the flexible sheet of material. Furthermore, the material retainer can be configured to assist in coupling the flexible sheet of material to the support frame. A projecting face provided on the material retainer allows a cam on the tensioning member to urge the material retainer into a coupled and/or tensioned position along the support frame. The hinged coupling can be comprised of a ball and socket to allow the tensioning member to rotate about the axis of rotation of this hinged coupling.

The tensioning member can be used to push the material retainer. This solves the problems of some earlier systems which required a deeper sign frame or a wider frame exterior to house the tensioning system. One embodiment of the present invention solves this earlier problem in part by allowing the material retainer to be pushed into position by a piece of the exterior frame. In this manner the frame can double as a tensioning member as well as a cover. This not only creates a more pleasing appearance of the sign, but it also requires less material to build the sign. Since the cost of the sign frame is directly related to the amount of material used in the sign frame, this tensioning system can result in a cheaper sign. Furthermore, it can be simpler to install which reduces labor costs as well.

A flat or beveled edge can be provided on the tensioning member to allow the tensioning member to be established in a plurality of positions. For example, the tensioning member can be established in merely an engaged position with the support frame. This position could also be referred to as a release position, since the tensioning member is releasable from the support frame when in this position. It may also be established in an intermediate position between—essentially an open position between the engaged and closed positions—via the flat or beveled edge. Finally, the tensioning member can be established in its closed position in which it secures the material retainer to the support frame.

A spring arm of the support frame can be provided to assist in coupling the tensioning member to the material retainer and/or to couple the material retainer to the support frame. This spring arm can be an integral part of the support frame itself and can be configured to be flexed through a range of positions. Furthermore, this spring arm can be configured so that the tensioning member is retained against the material retainer via the partially flexed spring arm.

The system can provide an audible indication to a user when the tensioning member is established in an engaged position with the support frame and also can provide an audible indication when the tensioning member is established in its closed position. This assists in assuring a user that the tensioning member has been properly installed and that the material retainer and flexible sheet of material have been installed in the tensioned position.

Several choices of material retainers can be utilized to engage the flexible sheet of material. A first material retainer can utilize an adhesion surface to be coupled to the flexible sheet of material and to properly position the flexible sheet of material on the material retainer. Furthermore, a projecting face can be provided to engage a cam of the tensioning member in order to urge the material retainer into its proper position for the tensioning system. A second material retainer can utilize two interlocking members to clamp the flexible sheet of material and retain the flexible sheet of material between the two interlocking members. A positioning system can be used in order to properly align the flexible sheet of material. For example, a groove that aligns with a hole on the flexible sheet of material can be used on one of the interlocking members. Or, a plurality of projections on a material-engaging side of one of the interlocking members can be used to align with holes provided in the flexible sheet of material.

Accordingly, it is an object of the invention to provide a support system for use in supporting flexible sheets of material that allows a user to quickly and efficiently install the flexible sheets of material.

It is also an object that the user not need to use tools in order to quickly and efficiently install or tension the flexible sheet of material at the support frame. Furthermore, it is an object of the invention that the user be able to easily assemble the flexible sheet of material onto the frame in a pre-tensioned position and then quickly tension the sheet of material by pushing the retainer of the flexible sheet of material into its tensioned position.

It is also an object of the invention that the user be able to apply a proper amount of tension for a given material and that this proper amount of tension be utilized to prevent over-tensioning of a sensitive material.

An additional object of the invention is that the user be able to hear via an audible feedback signal that the parts are being installed correctly. Furthermore, it is an object of the invention that the user be given an audible indication that the tensioned position has been properly achieved for the flexible sheet of material.

A further object of the invention is a support mechanism that allows a sign to be releasable from the sign support and sign backing in order to allow the user to quickly switch an old sign and replace it with a new sign.

Yet, another object of the invention is that the user be provided with material retainers that will retain the flexible sheet of material independent from the support frame to allow the material to be aligned on the material retainers independent from the support frame or even at some other time than that in which the installation onto the support frame occurs.

A further object of the invention is provision of either an adhesive coupling or a clamping coupling for engaging the flexible sheet of material.

BRIEF DESCRIPTION OF THE DRAWINGS

The features, aspects, and advantages of the present invention will become better understood with regard to the following description, appended claims, and accompanying drawings where:

DESCRIPTION

As can be easily understood, the basic concepts of the present invention may be embodied in a variety of ways. It involves both retention and tensioning techniques as well as devices to accomplish such techniques. In this application, the retention and tensioning techniques are disclosed as part of the results shown to be achieved by the various devices described and as steps which are inherent to utilization. They are simply the natural result of utilizing the devices as intended and described. In addition, while some devices are disclosed, it would be understood that these not only accomplish certain methods but also can be varied in a number of ways. Importantly, as to all of the foregoing, all of these facets should be understood to be encompassed by this disclosure.

Figure 1:
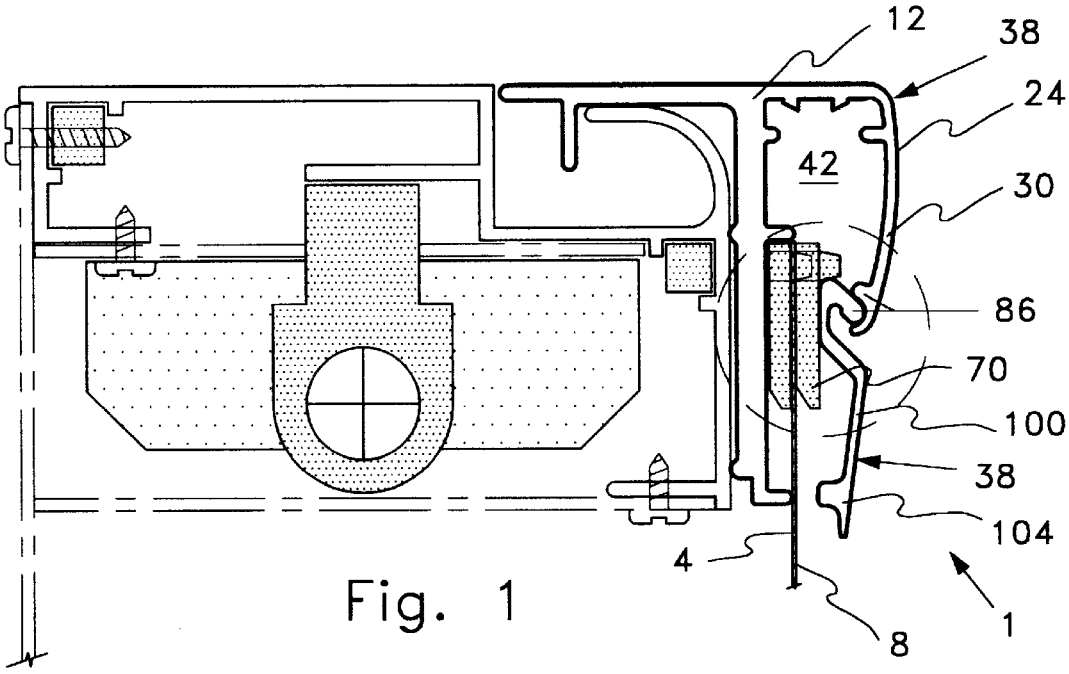
FIG. 1 shows a fragmented view of one embodiment of a sign system showing a ballast, light fixture, and retention system for a flexible sheet of material.
Figure 2:
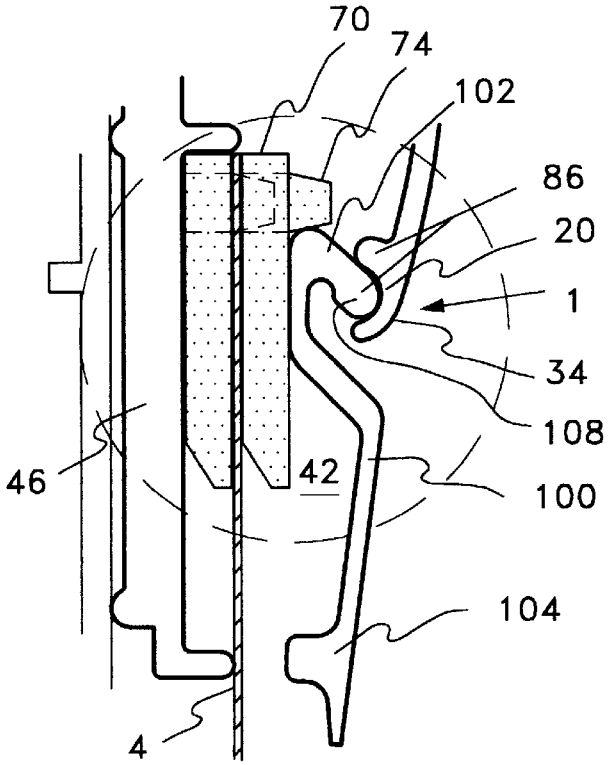
FIG. 2 shows an enlarged view of the retention system shown in FIG. 1 with the tensioning member in a closed position.

FIG. 1 shows a view of the retention system used to retain a flexible sheet of material, such as a sign, in engagement with a support frame as well as to secure the flexible sheet of material in a tensioned position. As can be seen in FIGS. 1 and 2, a support frame (12), a material retainer (70), a spring arm (30) of the support frame (12), and a tensioning member (100) can be used to support the flexible sheet of material (4). The tensioning member (100) can be coupled to the support frame via a hinged coupling (86). As the tensioning member is rotated about this hinged coupling, a cam surface on the tensioning member can force a projecting face (74) on the material retainer (70) along the support frame (12) and establish the material retainer in a releasably secured position. As the material retainer retaining the flexible sheet of material is moved along the support frame, the flexible sheet of material can be established in tension. Furthermore, the tensioning member (100) can be configured to supply an initial audible indication, such as a "snapping" sound, to let a user know that the tensioning member (100) has been correctly connected to or engaged with the support frame (12). As the tensioning member is rotated about the hinged coupling, the tensioning member can create another audible indication (e.g., a "snapping"

sound), to notify the user that the material retainer has been established in a preselected position or in order to indicate that the correct amount of tension for the flexible sheet of material has been applied.

The flexible sheet of material used in the present system can be a backing material—which might be translucent or transparent—or a sign, or some other flexible material used in a sign system. It should be understood that "flexible" is intended to encompass those types of material which utilize tensioning when mounted in sign supports, as would be readily understood by a person of ordinary skill in the art. The flexible sheet of material used in the present system will typically have a plurality of edges that will be retained by the support system. For purposes of this patent, the meaning of the word edge should be understood to mean the region of the material along an outside edge; it should not be limited to merely the extreme border of the material. Furthermore, reference to the drawings reveals an edge of the material being retained by material retainers. Since a variety of flexible materials can be used, each of these individual flexible materials will likely have a different coefficient of friction. It is also envisioned that these flexible sheets of material may have openings to allow specific positioning of the material onto the support system or onto a material retainer which is part of the support system. These openings may be similar to the type of openings used in computer printer paper which are often referred to as tractor-feed holes. Furthermore, the flexible sheet of material may typically have a loose end (7) which is positioned onto the support system as well as an end (8) that engages the support system but that requires tensioning relative to the other supports used in the support system. It should be understood that tensioning is intended to have the meaning normally attributed to it in the sign industry—i.e., making a flexible sheet of material more taut.

Figures 3, 4:
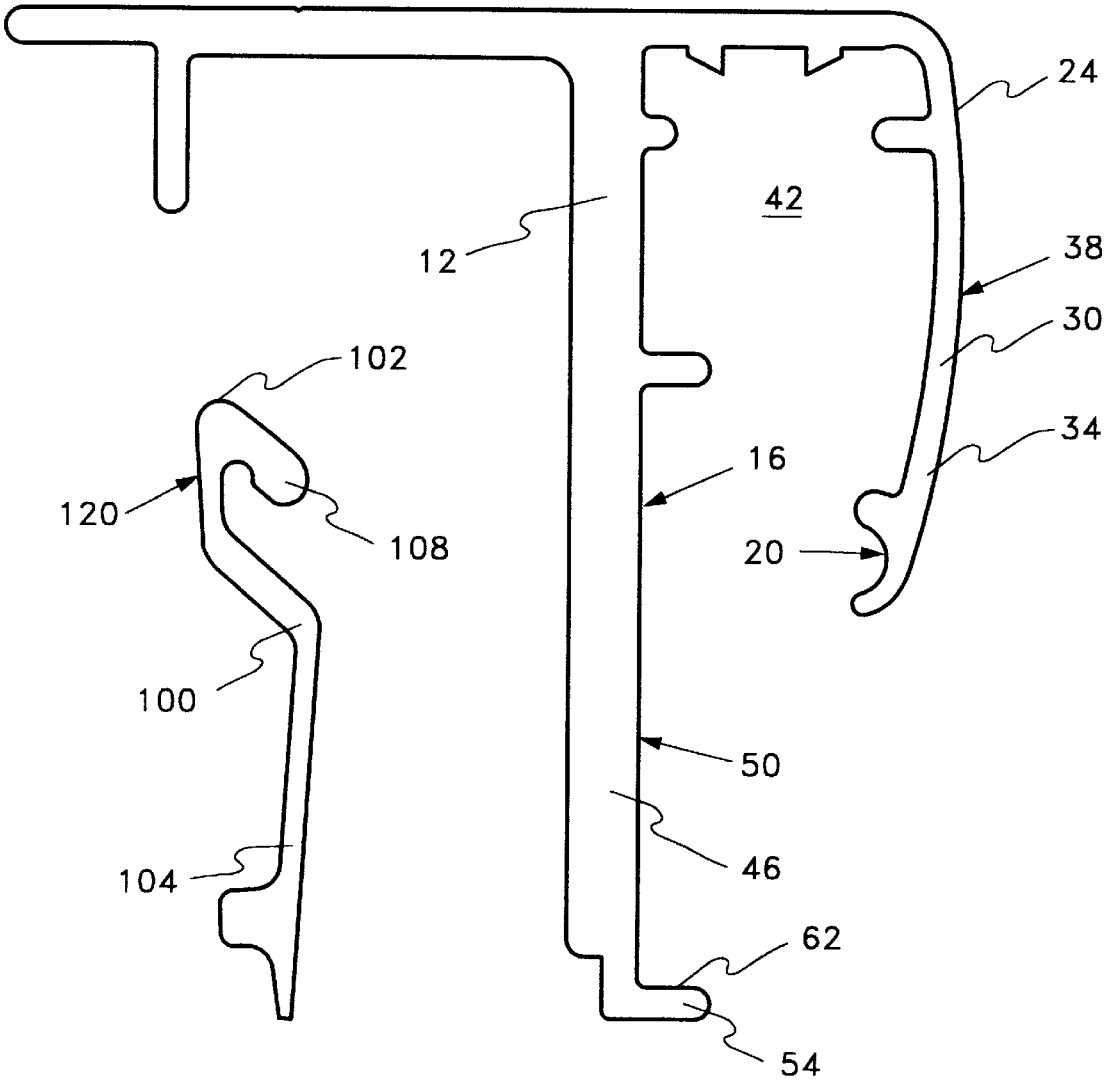
FIG. 3 shows one embodiment of a support frame that can be used in the retention system.
FIG. 4 shows a tensioning member for use with the support frame of FIG. 3.

Referring now to FIG. 3, an embodiment of a support frame (12) can be seen. The support frame can be configured or sized to support the flexible sheet of material in order to withstand the forces that result from not only supporting the weight of the flexible sheet of material but also any tension forces exerted from other supports in the system. A support surface (16) is shown in FIG. 3 along a main vertical member (46). This support surface (16) can be used to engage with a material retainer (70) to hold or retain the sheet of flexible material to the support frame. In addition, the support frame (12) can use a spring (24) coupled to the support frame to provide a force against the material retainer when it is established in a tension position. A tensioned position should be understood to be a position in which the material retainer would be located when all sides of the flexible material have been completely installed. This spring may comprise a spring arm (30) which forms an integral part of the support frame (12) shown in FIG. 3. The spring arm can be configured to exert a force against the material retainer (70) when the spring arm is flexed from its unflexed position. The spring arm can have an unflexed normal position which can be flexed through a range of flexed positions. One manner of accomplishing this is through the use of extruded aluminum to manufacture the spring arm. However, it is also envisioned that plastic and other materials could be used as well.

The tensioning member (100) can be inserted against the spring arm to force the spring arm into its flexed position. In this manner, the spring arm (30) can then force the tensioning member through a partial rotation due to the spring force acting against the tensioning member and the shape of the tensioning member's cam surface. (It should be understood that the meaning of partial rotation is also intended to encompass instances where the tensioning member is fully rotated.) As a result, the spring arm and tensioning member can accomplish self-tensioning of the flexible sheet of material—as the lever arm need only be manually rotated partially while the spring force can complete the tensioning. Furthermore, the spring arm can force the tensioning member against the material retainer while the spring arm is still in a flexed position. In this manner, the material retainer can be retained against the support frame (12) after the material retainer has been established in a tensioned position. The spring arm can be sized to exert enough force that it is sufficient to produce an audible indication when a surface of the tensioning member is forced against the sheet of material or effectively forced against any support lying underneath the flexible sheet of material. Furthermore, the spring arm can be sized or configured to releasably secure the flat face (120) of the tensioning member against the material retainer.

Figure 9:
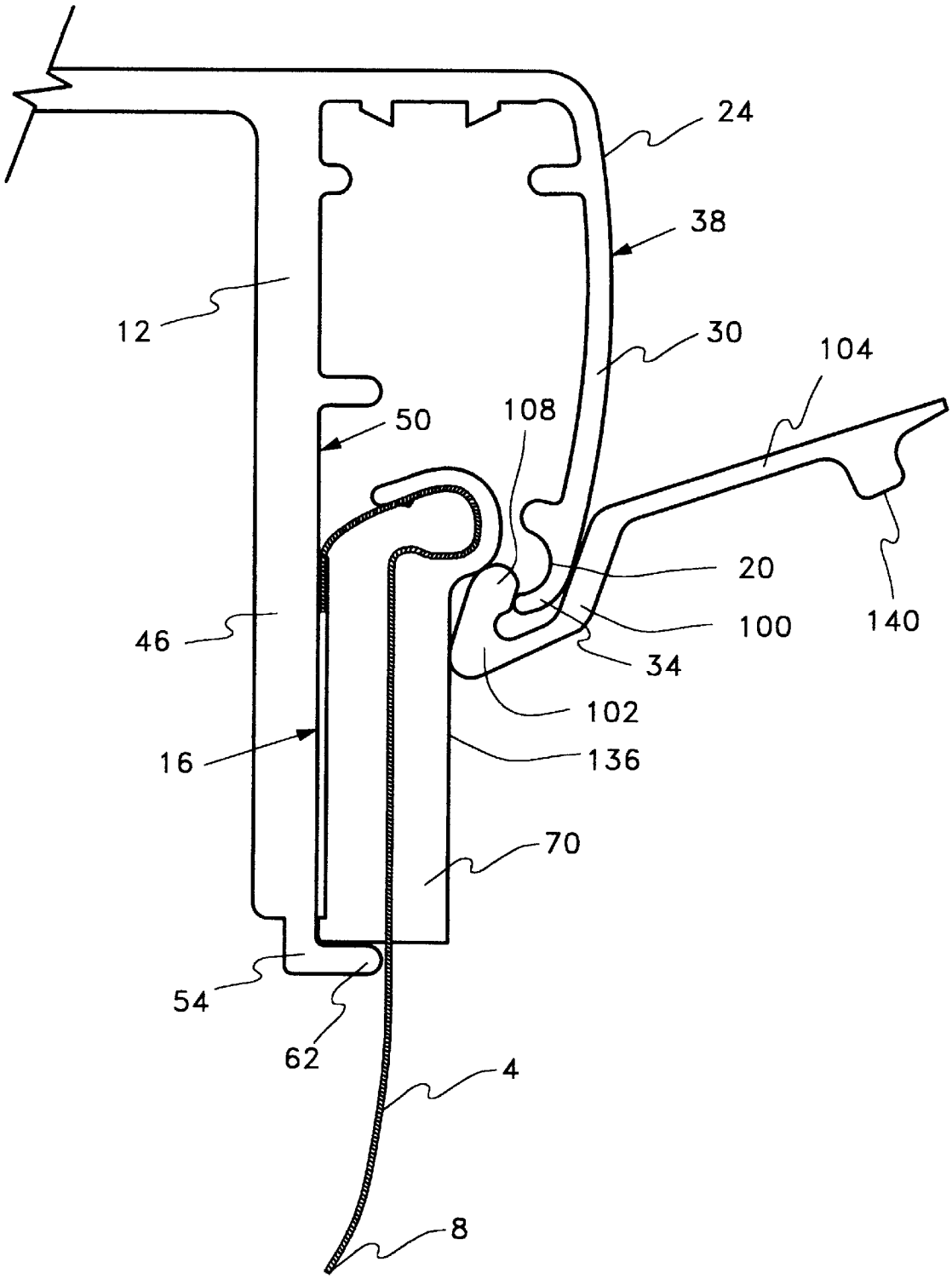
FIG. 9 shows establishment of the material retainer in FIG. 8 in a pre-tension position as well as a tensioning member being engaged with the support frame.

The spring arm can have a distal end (34) in which a saddle or socket (20) can be located for use in coupling the tensioning member (100) to the support frame. In this fashion, the socket (20) serves as a coupling element. It is also envisioned, however, that this socket (20) might be located at other points along the spring arm. The tensioning member (100) and spring arm (30) combination allow the spring arm to be pushed through a range of flexed positions, as shown by the dashed lines in FIGS. 10 and 11, from an initial unflexed position as shown in FIG. 9.

The support frame (12) typically provides an exterior surface (38), which is the part of the support frame seen by a person viewing an installed sign. One advantage of the present sign system is that the spring arm (30) and the tensioning member (100) can form part of the exterior surface (38). Therefore, not only do they serve the functional purpose of tensioning and retaining the flexible sheet of material, but also, they serve to conceal or cover the frame interior (42) and/or the material retainer (70). Furthermore, they minimize the weight and cost of the sign by being utilized for two purposes.

The support frame (12) also can comprise a main vertical member (46) having a substantially planar sliding surface (50) that permits a substantially planar sliding surface of a material retainer (70) to slide along it, (i.e., in substantially parallel relationship to it). This can be seen by reference to FIGS. 8, 9, and 10 in which the substantially planar sliding surface (50) of the main vertical member (46) is shown with the substantially planar sliding surface (82) of the material retainer (70) being pushed along it. As one can see in FIGS. 8, 9, and 10, in some cases the flexible material may be disposed between the two sliding surfaces without substantially affecting the sliding action. In addition to the main vertical member, a material retainer support (54) can be used to establish the material retainer in a pre-tensioned position. As can be seen in FIG. 9, the material retainer is established on the material retainer support (54), such as a flange (62), in a pre-tensioned position. In this manner, the system allows a user to position the untensioned sign in this untensioned position before adding the tensioning member to apply tension. This allows the user to have more hands free in working with the tensioning member, rather than having to use one hand to position the material retainer while trying to also manipulate the tensioning member.

Figure 12:
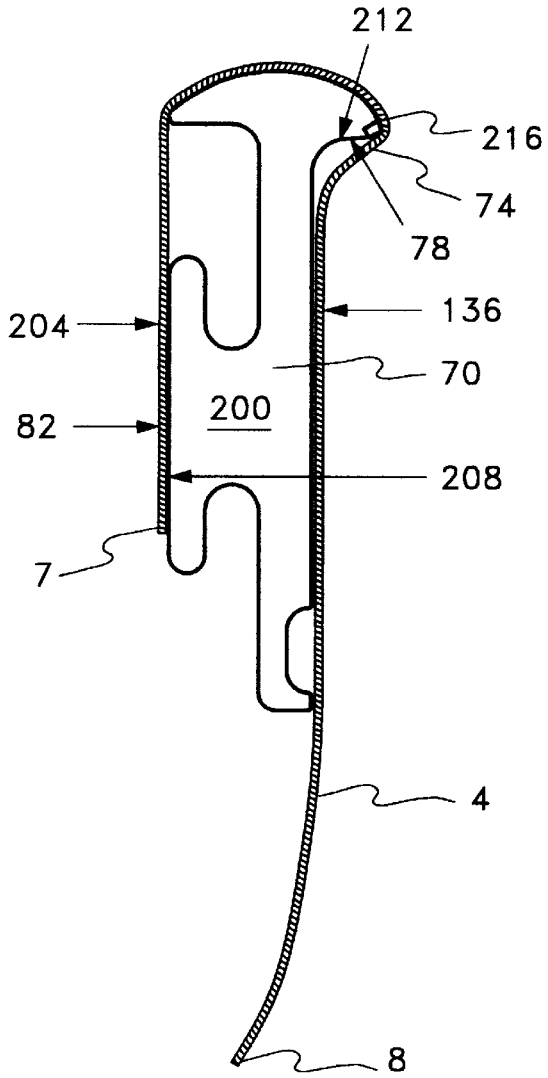
FIG. 12 shows one type of material retainer with a flexible sheet of material adhesively coupled to an adhesive surface of the material retainer.
Figure 13:
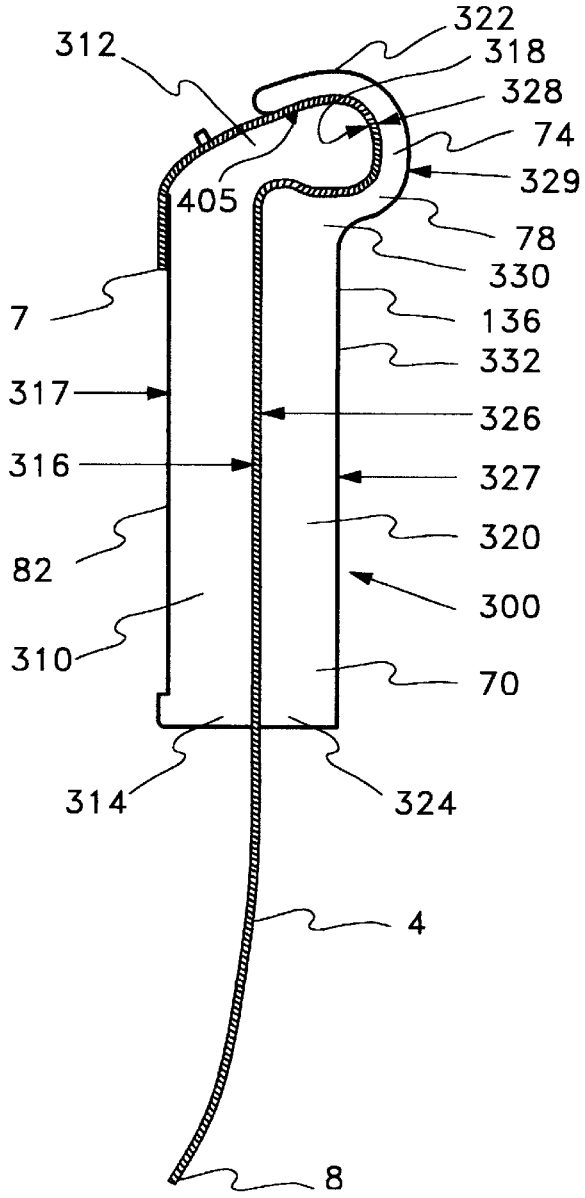
FIG. 13 shows one type of material retainer with a flexible sheet of material coupled to the material retainer between interlocking parts.

FIGS. 12 and 13 show alternative embodiments of material retainer (70). One important feature of the material retainer is that it is a device that can be designed to be independent or separable from the support frame (12). By being independent from the support frame, it is often easier to work with the flexible sheet of material and to establish the flexible sheet of material on the material retainer in a secure or properly aligned position. The material retainer also can be capable of retaining (e.g., clamping or holding in some position) the flexible sheet of material independent from the support frame. Furthermore, the material retainer can serve the function of assisting in coupling the flexible sheet of material to the support frame. It also can be configured to assist in tensioning the flexible sheet of material. An additional feature of the material retainer is that it can be specifically configured to move or slide along the main vertical member (46) of support frame (12).

Figure 10:
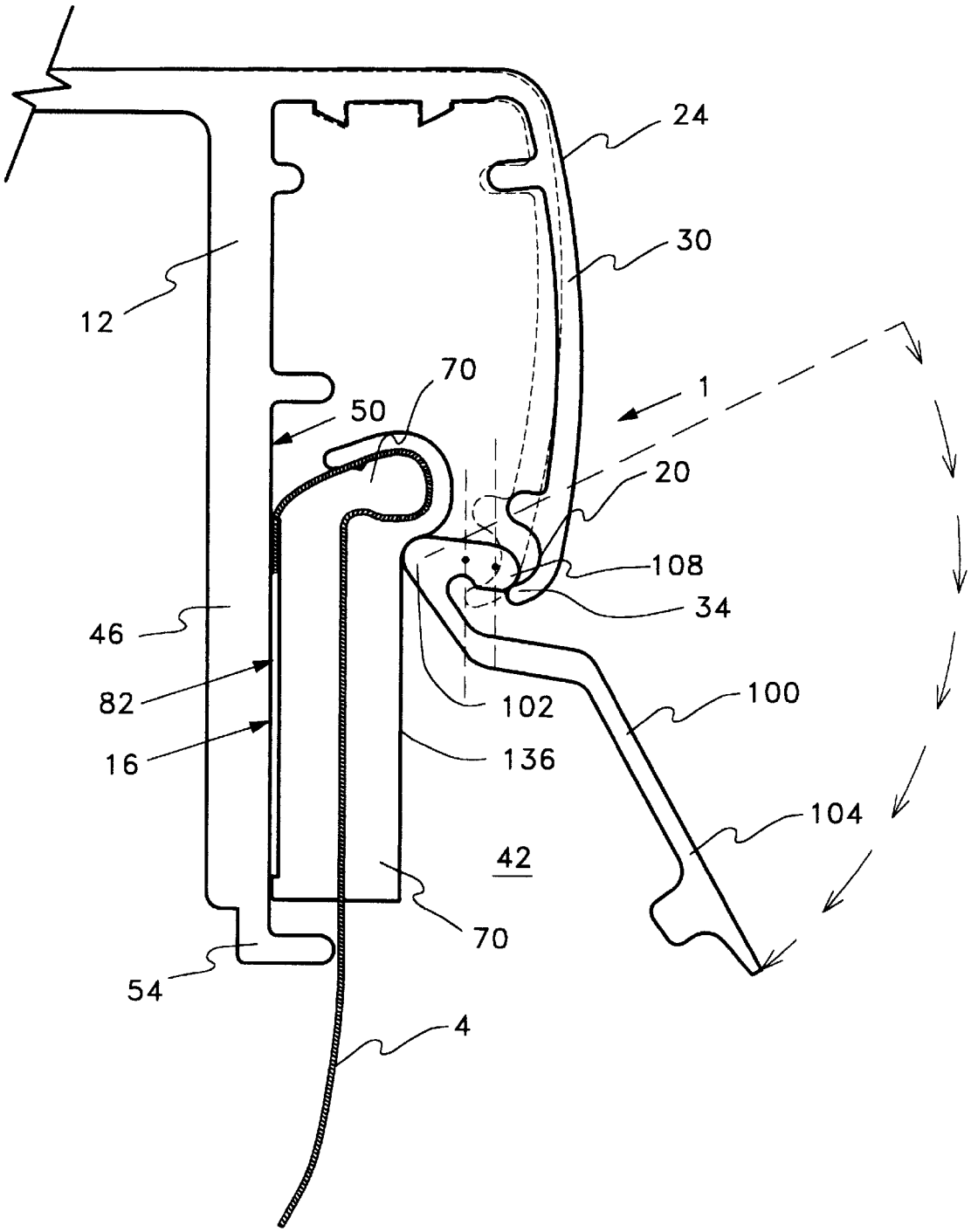
FIG. 10 shows initialization of the step of tensioning the flexible sign face shown in FIGS. 8 and 9 as well as movement of a tensioning member through an arc with the tensioning member shown in an open position.

As can be seen in FIGS. 12 and 13, these material retainers utilize a projecting face (74) which can be configured to engage with the cam (102) of tensioning member (100) as seen in FIG. 10. The projecting face (74) has a shoulder surface (78) which engages the cam (102). For purposes of this patent, a shoulder surface or shoulder is defined to be a surface adjacent to or along the edge of a higher, more prominent part. Furthermore, the material retainer can utilize a sliding surface (82) that can be substantially planar. By having a substantially planar sliding surface, the material retainer (70) facilitates sliding along main vertical member (46) which can also be substantially planar. Substantially planar does not necessarily mean completely smooth or completely flat. Rather, substantially planar is intended to mean a sliding surface which interfaces with the interfacing surface so as to provide a substantially planar plane of contact surfaces that permit the sliding surface to slide along the interfacing surface. The preferred method of accomplishing this is by utilizing a substantially flat surface.

In interfacing with the flexible sheet of material (4), the material retainer (70) typically engages a substantial portion of at least one edge of the flexible sheet of material. Furthermore, this substantial portion can be an entire edge. By engaging most of, if not the entire edge, the system is able to tension a substantial portion or even the entire side of the flexible sheet of material. Furthermore, this also can allow the entire side to be tensioned simultaneously. The flexible sheet of material can be tensioned equally, thereby preventing the material from puckering, gathering, or wrinkling.

Figure 19:
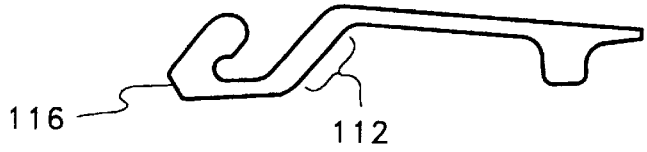
FIG. 19 shows an alternative tensioning member having a flattened or beveled cam for establishing it in an intermediate position.

As shown in FIG. 4, the tensioning member (100) can be comprised of a lever arm (104), a cam surface (102), a ball end (108), and a flat face (120). The ball end (108) can be configured for inserting on a saddle or within a socket, such as a socket (20) of spring arm (30). In this fashion, the tensioning member (100) is rotatable about such a socket. The lever arm (104) can accomplish this rotation as it can be shaped or configured to force the ball end (108) about socket (20). This rotation need not be a full rotation rather it can simply be a partial rotation as shown in the figures. The lever arm can be used to force cam (102) against a shoulder (78) of a projecting face (74) of a material retainer (70). In this fashion, the cam pushes the material retainer resulting in tensioning of the flexible sheet of material. It should be understood that pushing is intended to mean moving or endeavoring to move the material retainer ahead of the cam. The cam surface (102) is configured to be forced against the shoulder of the projecting face when the lever arm is partially rotated. An operator pushing on the lever arm can cause the ball end (108) to partially rotate within socket (20) and similarly cause cam (102) to be forced against the shoulder of the material retainer (70). As a result of pushing of the cam against the shoulder of the material retainer, the material retainer can be urged into a releasable secured position along the support frame (12). The intermediate portion (112) of the tensioning member between the cam and the lever arm, as shown in FIG. 19, can be varied in curvature and length to accomplish differing degrees of coupling for different coupling arrangements. In addition, it can be configured to make the tensioning member releasable from the support frame when the material retainer is established in a pre-tensioned position.

Figure 20:
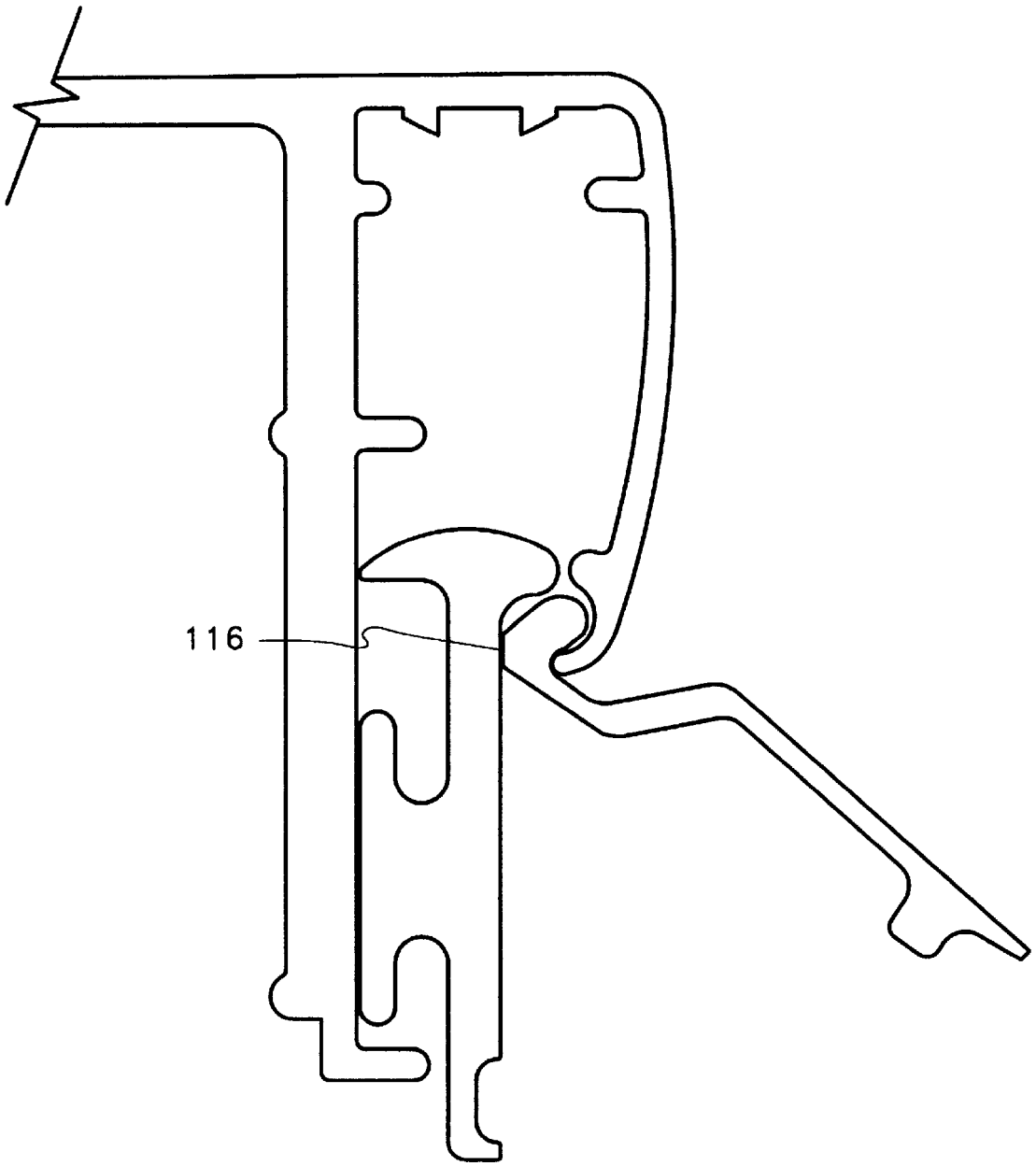
FIG. 20 shows the tensioning member of FIG. 19 with the beveled end of the cam established against the material retainer and placing the tensioning member in a stationary intermediate position.
Figure 21:
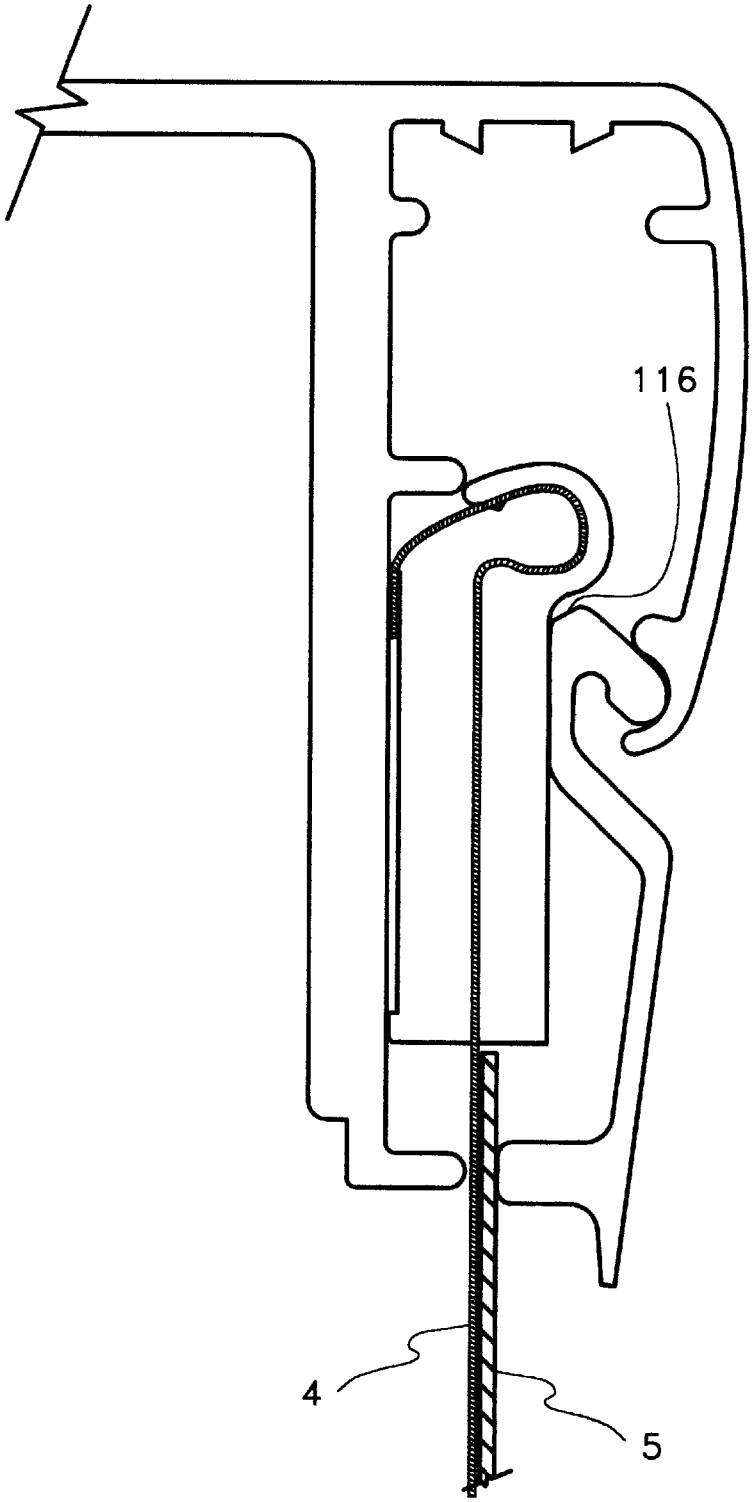
FIG. 21 shows the tensioning member of FIGS. 19 and 20 established in a closed position with a second sheet of material, such as a poster, retained between the end of the tensioning member and the support frame, as well as a sign backing in the tensioned position underneath the poster.

The tensioning member (100) can utilize some type of intermediate restraint, such as at least one flat or beveled edge (116), as shown in FIGS. 19, 20 and 21 to establish at least one intermediate position (i.e., a position between the engaged and closed positions) for the tensioning member when it is coupled to the support frame. For example, a first position can be established as shown in FIG. 9 in which the tensioning member is first coupled to the support frame via ball end (108) and socket (20). Furthermore, the beveled edge allows a second position in which the tensioning member is attached to the support frame yet not completely closed. The beveled edge can rest against a substantially flat surface of the material retainer until it is forced into an alternative position. The tensioning member can remain in this position without accidently closing. By varying cam dimensions and sizes, various positions and tensions may be established. Furthermore, it may even facilitate tensioning of a flexible sheet of material in a high wind situation—by allowing an installer to more securely couple a material retainer to the support frame, via the intermediate position of the intermediate restraint, before installing the opposing side. This can also facilitate the insertion of a second piece of material into the sign system. This second piece of material can be either flexible or non-flexible. For example, it could be used to insert a cardboard sign into a sign system having a retained transparency or translucent overlay. Furthermore, this intermediate position can be used to prevent marring of a painted sign frame once a backing material is installed. Such marring might occur when a sign frame is first constructed and painted and then a new sign is desired to be installed. The user simply releases the tensioning member into the intermediate position and removes the poster board or sign without removing the sign backing. By use of the intermediate position, the tensioning member is not forced all the way back against the support frame; and, therefore, it does not scratch that painted surface. This is also a time and money saving feature of this embodiment of the invention.

Figure 11:
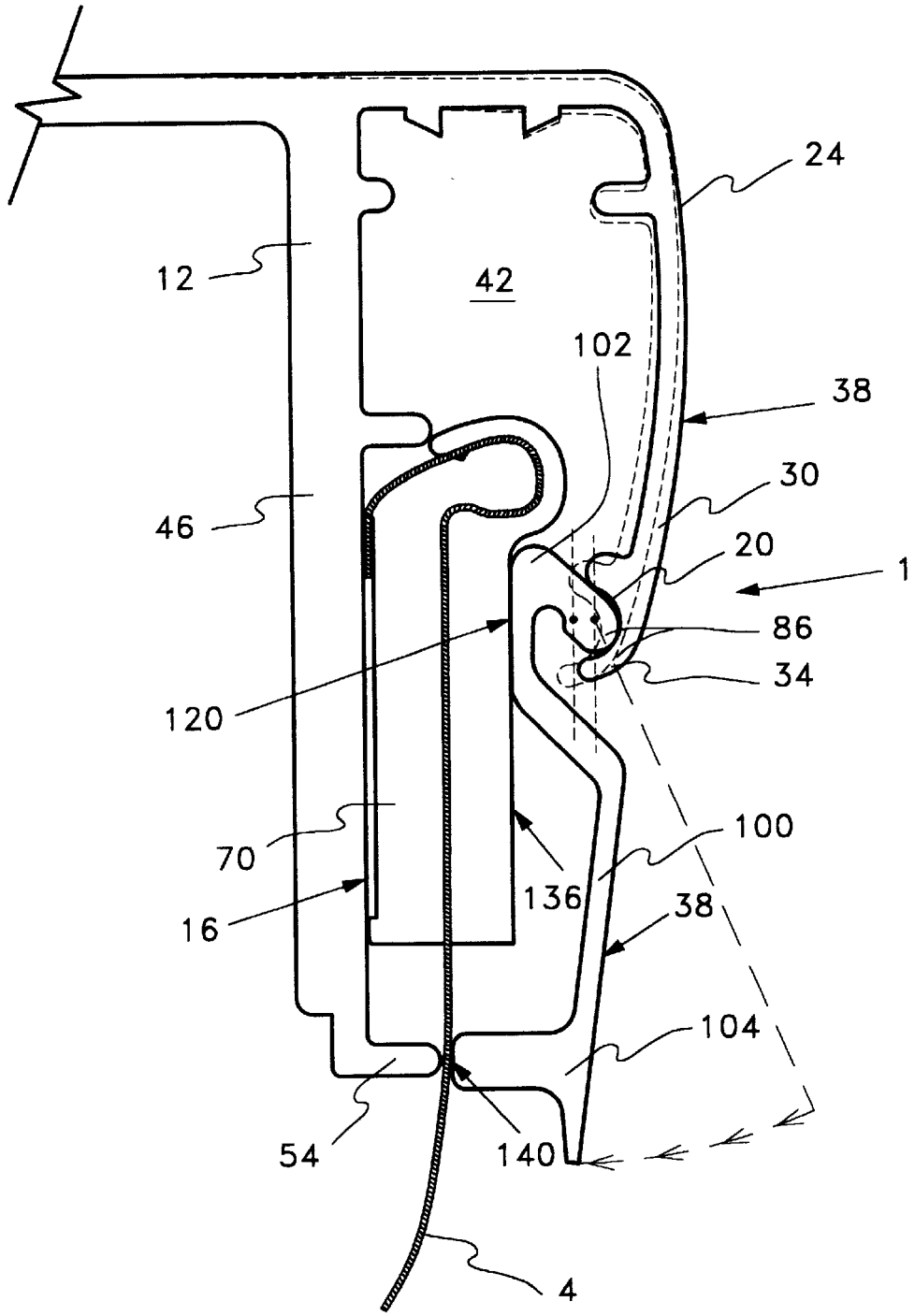
FIG. 11 shows establishment of the material retainer shown in FIGS. 8, 9, and 10 in a secured position and the tensioning member in a closed position.

The tensioning member (100) also utilizes a flat face (120) as shown in FIG. 11. Flat surface (120) allows the tensioning member to be established in its closed or tensioned position. The spring arm (24) acting against tensioning member (100) can force the tensioning member against the material retainer (70) to retain the material retainer in a secured position with the support frame (12).

As noted earlier, the tensioning member can be coupled to the support frame. This can be accomplished through a ball and socket arrangement wherein the tensioning member (100) is hingeably coupled to the support frame via the hinged coupling of ball end (108) and socket (20). This hinged coupling permits the tensioning member to be rotatable through the range of releasably engaged, intermediate, and closed positions. The engaged position can be seen in FIG. 9, an intermediate position can be seen in FIG. 20, and a closed position can be seen in FIG. 11.

In addition, lever arm (104) can force the spring (24), such as spring arm (30), into a flexed position. This can be accomplished in at least partially rotating the tensioning member from the intial engaged position through the range of open positions or even to the closed position. The shape of the tensioning member can result in forcing the spring arm into a flexed position as the cam is forced against the surface of the material retainer. The cam can then allow the spring arm to move back towards its unflexed position as the tensioning member continues to rotate. A spring force can be exerted by the spring arm to force the tensioning member towards its closed position. This can be seen through reference to FIGS. 8 through 11. As noted earlier, the spring arm can force the tensioning member against the material retainer and can consequently force the material retainer against the support frame (12). In this fashion, the material retainer can be securely yet releasably held against the support frame. Moreover, since the material retainer retains the flexible sheet of material, the flexible sheet of material is also coupled or secured to the support frame. Therefore, the spring arm indirectly retains the flexible sheet of material and the material retainer.

The shape of the tensioning member (100) as well as its interaction with the support frame (12) and the shape of the material retainer (70) allow the tensioning member to accomplish a predetermined amount of tensioning. By altering cam length and size, as those of ordinary skill in the art would readily understand, the tensioning member (100) can be designed with a material retainer shape in mind so as to produce an exact or precise amount of movement of the material retainer when the two are coupled, e.g., via the cam of the tensioning member and the projecting face of the material retainer. In this fashion, with knowledge of the amount of tension desired, one can specifically design a system to accomplish a predetermined amount of tension. This is quite important for materials which cannot be tensioned or stretched beyond a certain limit without causing damage to the material. For example, the PANAFLEX™ 600/645 GPS Series of material is such a material. Furthermore, tensioning plays a very important role in a display system where it is important to provide a smooth surface. Therefore, by designing a system in which the tensioning can be predetermined, one can ensure that the display will be an attractive one when it is erected at the support frame. This permits one to take the dimensions of a support frame and then fabricate the sign at another location. The sign can then be quickly installed at the support frame without additional adjustment.

The system can be designed to provide the predetermined amount of tension by moving the material retainer a predetermined distance. This can be accomplished regardless of the coefficient of friction of the material being supported. This also is an important feature as it allows a user to display a sign without worrying about the coefficient of friction of the material being displayed. The material need only be mounted in a material retainer which, as noted earlier, functions with the tensioning member to accomplish a predetermined amount of tensioning.

As can be seen by reference to FIGS. 8 through 11, the tensioning member can be shaped or configured to push the independent material retainer in a direction which tensions the flexible sheet of material. Tensioning can occur when the tensioning member is at least partially moved about the hinged coupling toward or so as to push the material retainer via cam (102). This pushing feature is important in that it is a system which allows the user to simply place the material retainer on the support frame and then push it into place. The material retainer does not have to be fitted to another piece—merely inserted. Since no attachments are necessary, the pushing feature allows the material retainer to be quickly installed on as well as removed from the frame.

Another advantage of this system is the fact that the tensioning of the flexible sheet of material can be applied from the front of a support frame, i.e., the side of the support frame which the viewing audience views once the sign is displayed. Some prior systems have required that the tensioning be accomplished from the back of the sign. This made it difficult in some locations to access the tensioning devices. However, by tensioning from the front of the support frame, for example with a tensioning member, the user should typically have plenty of room to work. Furthermore, it also facilitates locating the signs in positions where access from the rear would not be possible at all, for example against a wall.

Figure 8:
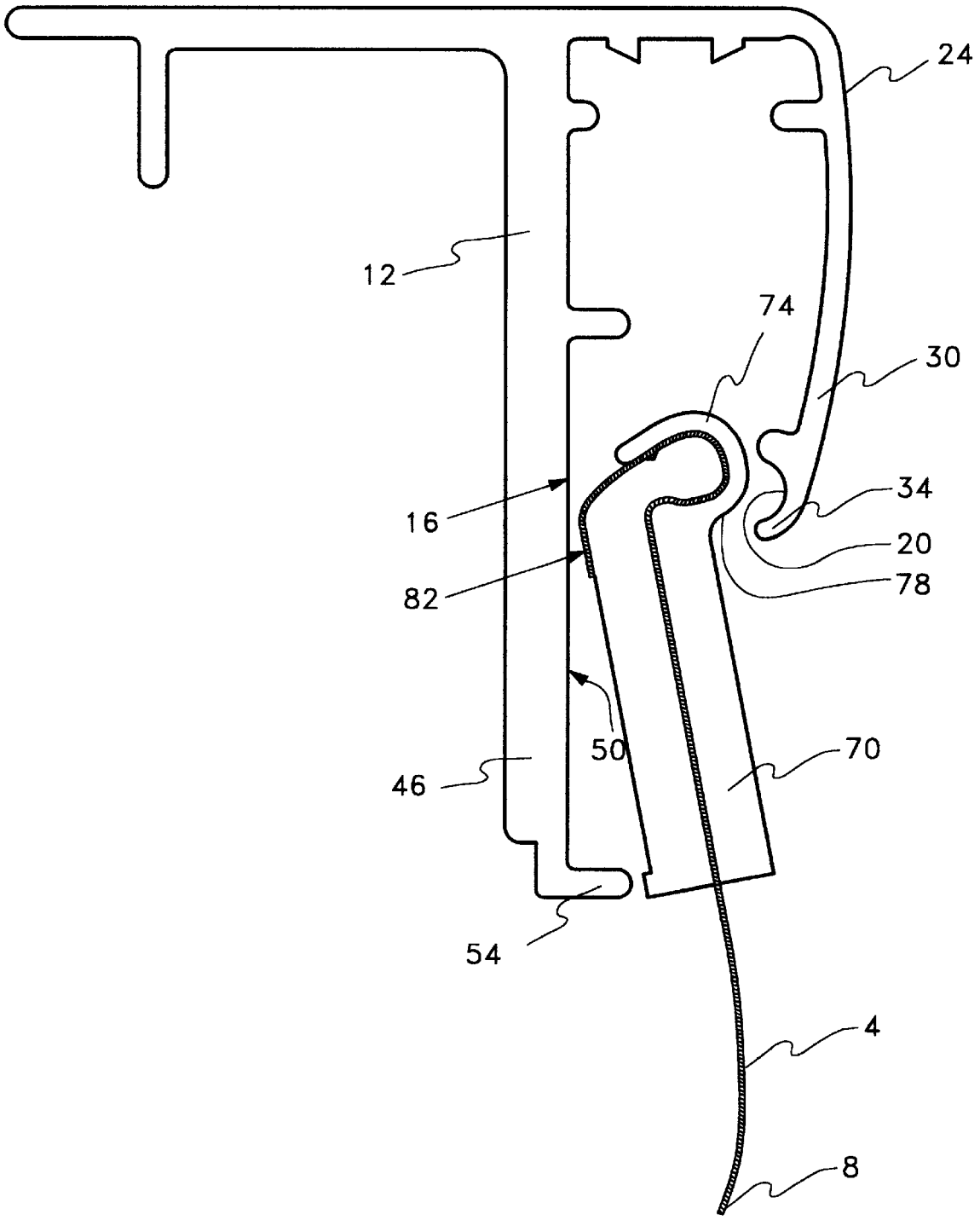
FIG. 8 shows a second embodiment of a material retainer being established in a support frame.

Yet another important feature of the tensioning member is the fact that it can be removed or released from the support frame as shown via FIGS. 8 and 9. This facilitates a change-out of a tensioned flexible sheet of material once a change is required. In this fashion, a fast food restaurant, for example, could utilize several different signs, for example, during different times of the year or even day. The releasable tensioning member (100) would permit the user to release the tensioning member from the frame and remove the old sign for replacement with the new sign. In this fashion, the sign box frame would not need to be removed or perhaps sent back to the factory for a replacement of the sign. Furthermore, this also facilitates acessing the internal mechanisms of the sign such as the ballasts and the lamps used to provide backlighting of some types of signs. The flexible sheet of material can be removed from the front of the sign; therefore, it facilitates direct access to these components.

An additional feature of the system is the fact that it can produce an audible indication when the tensioning member is established in engagement with the support frame as well as when the tensioning member is established in a closed position indicating that the material retainer is established in a tensioned position or similar position on the support frame (12). An audible indicator is utilized to produce the audible indication. The audible indicator can be comprised of the ball end of tensioning member (100) and socket (20) of support frame (12). For example, the close fit arrangement of these parts when installed can cause a "snapping" sound when the parts are engaged in their close-fit relationship or coupled position. This mechanical action of the system would be easily understood by a person of ordinary skill in the art. Furthermore, by extruding, milling or shaping these parts with knowledge of the need to create an audible indication, one can create a predetermined audible indication for such parts or similar parts used to create an audible indication. For example, by knowing that the parts should make such a sound, one could easily design two parts that will require enough force to force them into a coupled arrangement while at the same time causing them to create a sound for the user to hear when the coupling is established. It should be understood that an audible indication is not just any sound, it must be a sound that can be heard by an installer under typical installation conditions. It could also be possible to design the parts so that they indicate proper alignment of the parts by way of a mechanical indication that can be felt by the installer when installing the tensioning system.

In addition, an audible indicator can be used when the material retainer (70) is established in its tensioned or secured position as indicated by the tensioning member achieving its closed position shown in FIG. 11. The tensioning member can be used to produce such an audible indication by a force from the spring (24) which forces the tensioning member (100) against either the flexible sheet of material or provides enough force to create a sound when the tensioning member (100) is forced against the flexible sheet of material and a part of the support frame or material retainer located behind such a sheet of flexible material. In this fashion, the system provides an assurance to the user that the material retainer (70) has been secured to the support frame or established in its intended position. These features are quite important as they can help to assure the user that the system has been properly constructed and to reduce the user's worry about the frame coming open due to improper assembly. One manner in which a sound or audible indication could be produced is through the use of a substantially flat surface on the material retainer such as surface (136), and a substantially flat surface on the tensioning member (100) such as surface (140) shown at the distal end (104) of tensioning end (100) in FIG. 11. In this manner when these flat sides are forced against one another with sufficient force (even with the flexible material located between them), a sound is produced. Again, such a sound could be predetermined through proper design of the elements involved. This might involve the force exerted by the spring, the type of surfaces that are intended to contact one another, and the construction of the tensioning member.

Figure 7:
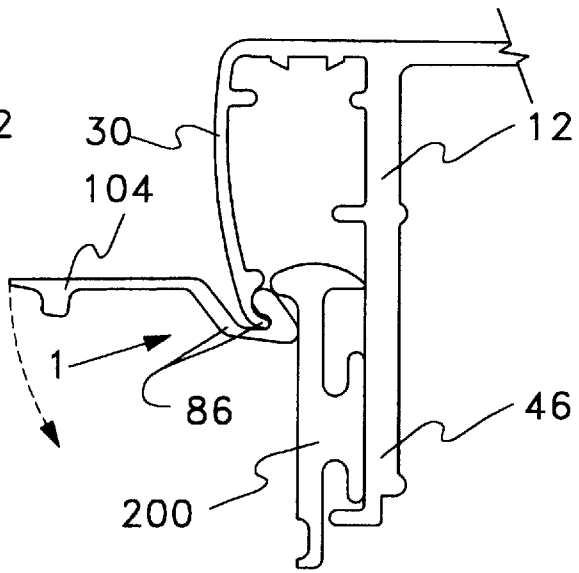
FIG. 7 shows initiation of the step of pushing a material retainer into a secured position.
Figure 6:
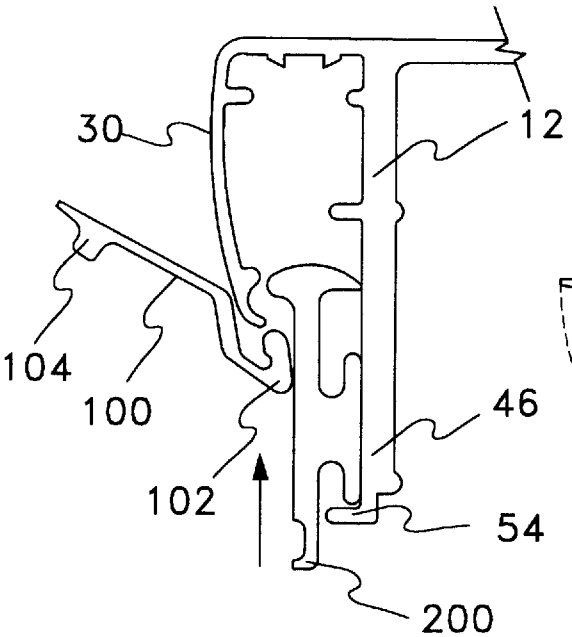
FIG. 6 shows insertion of a tensioning member into a support frame holding a material retainer in a pre-tension position wherein the tensioning member is about to engage the support frame.
Figure 5:
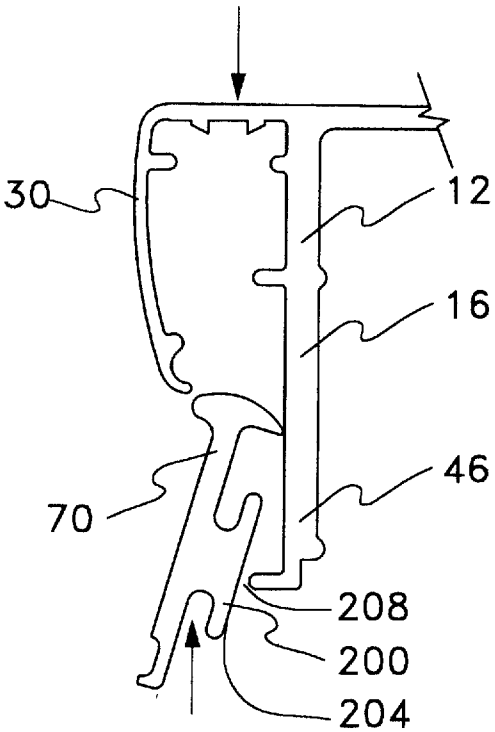
FIG. 5 shows insertion of a material retainer into a support frame.

Turning now to the proper method of using the system disclosed in this patent, one can refer to the figures, specifically FIGS. 5, 6, and 7, as well as FIGS. 8 through 11. Typically, a user will initially provide a support frame on which the flexible sheet of material is to be supported. Furthermore, the flexible sheet of material can then be coupled to a material retainer (70). This can be accomplished in several ways, which shall be described below. The flexible sheet of material can be retained by the material retainer independently from the support frame. At least one material retainer which is independent from the support frame can be utilized to accomplish this function. The material retainer also can engage at least a portion of the flexible sheet of material; although, it is preferred that the material retainer engage a substantial portion of at least one edge of the flexible sheet of material. This facilitates tensioning the entire side of the flexible sheet of material rather than requiring piecemeal tensioning of the sides as accomplished by some earlier systems. Again, this is a significant advantage of the present system. Next, the material retainer can be positioned in a pre-tensioned position with the support frame (12). As can be seen in FIGS. 8 and 9, the material retainer can be slipped through the mouth of the support frame (12) as defined by material retainer support (54) and distal end (34) of the spring arm (30). The pre-tensioned position can be seen best in FIG. 9 in which the material retainer (70) is established on material retainer support (54) prior to the step of applying tension with the tensioning member. Material retainer support (54) can serve to support the material retainer (70) in this pre-tensioned position. In this fashion, the material retainer can be established in the pre-tensioned position and allowed to rest there as other material retainers are established first in their respective positions. For example, for a four-sided sign utilizing four material retainers, each material retainer retaining a single side of the sign, each material retainer can be established in its pre-tensioned position before being moved to its tensioned position, as described below, to establish the sign in tension.

Figure 17:
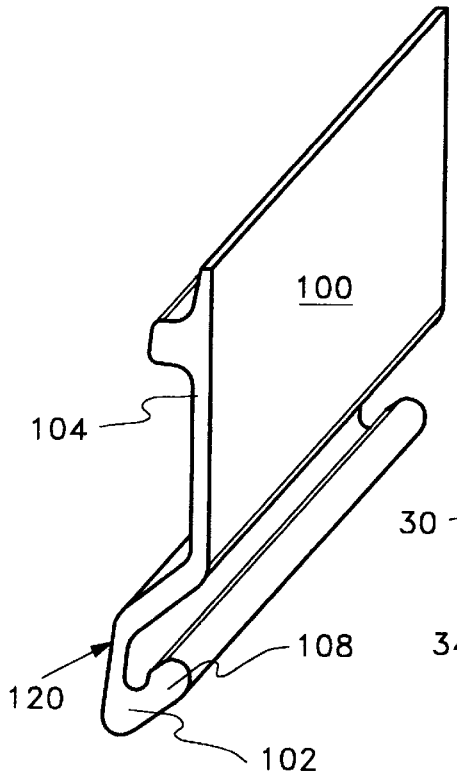
FIG. 17 shows a perspective view of an alternative tensioning member showing the continuous length of the member.
Figure 18:
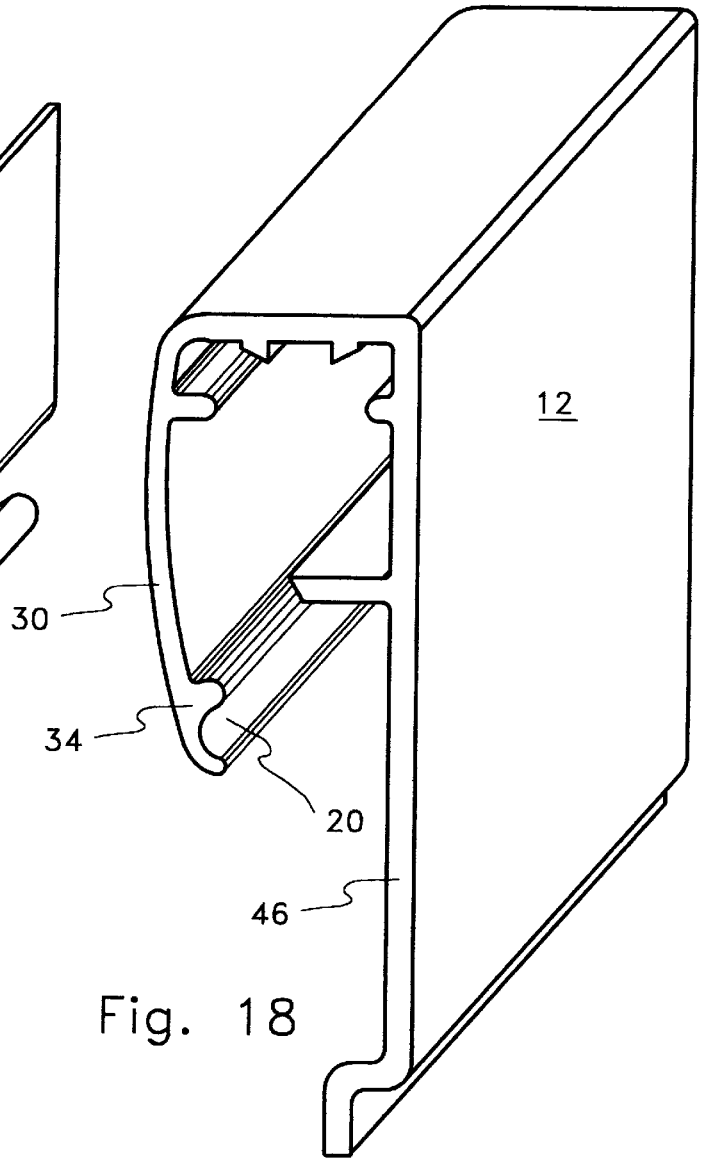
FIG. 18 shows a perspective view of an alternative support frame used for engagement with the tensioning member shown in FIG. 17.
Figure 22:
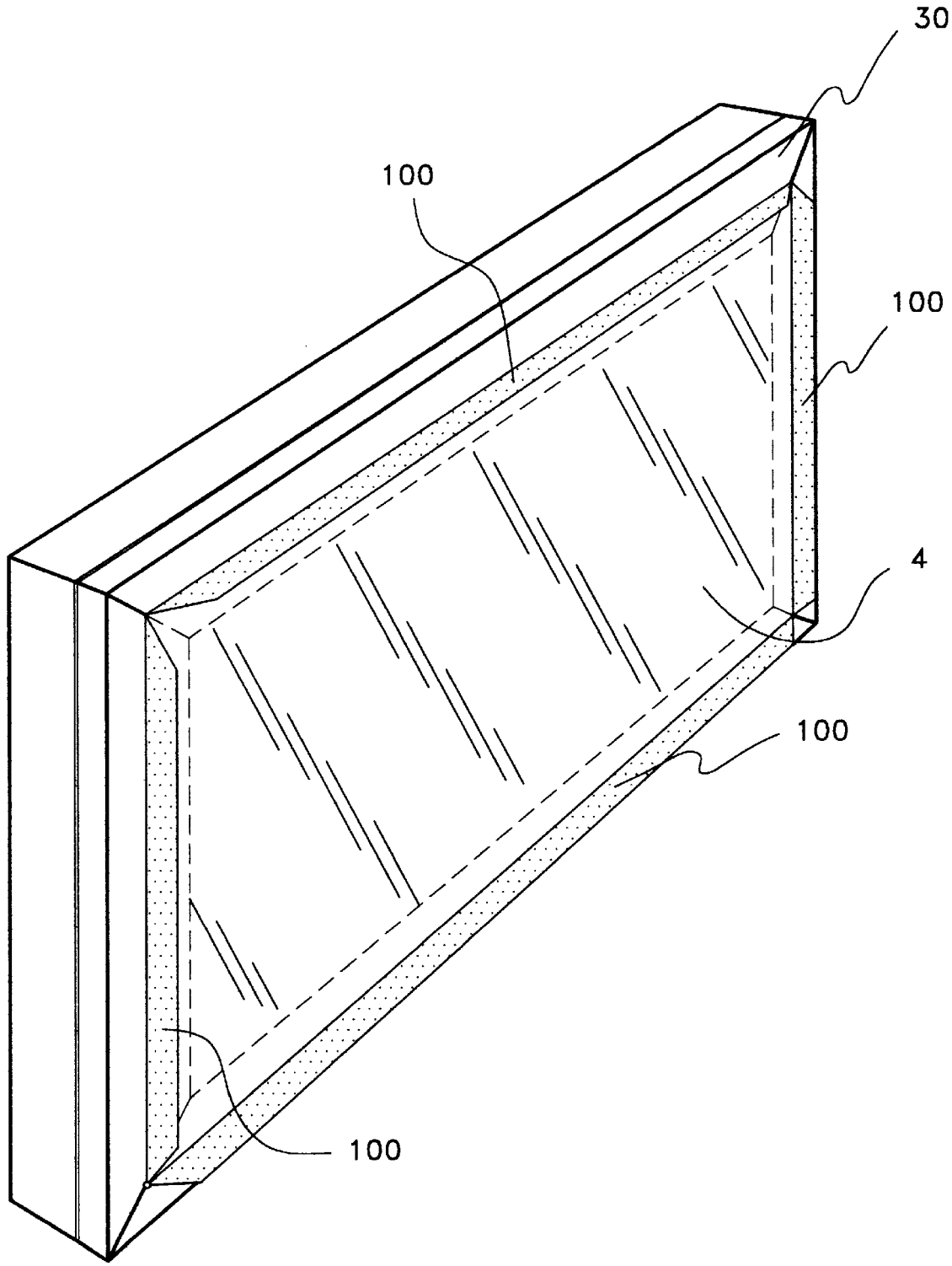
FIG. 22 shows a perspective view of a flexible sheet of material being installed in a support frame, wherein the tensioning members are shown in open positions and their respective closed positions are shown by dashed lines.

The tensioning member (100) next can be coupled to the support frame (12). This is shown, for example, in FIG. 9. The insertion of the tensioning member in FIG. 9 can produce an audible indication when the tensioning member is established in its proper position. This audible indication is useful in establishing that the tensioning member has been properly aligned in the socket. This can be very important when utilizing a system having a continuous length for engaging a substantial portion of an edge. Examples of a tensioning member having continuous length and a support frame having continuous length are shown in FIGS. 17, 18, and 22. The combination of these two pieces would form a continuous hinged coupling. For example, one may want to ensure that the tensioning member was properly installed on the sign supporting the entire edge before beginning manipulation of the lever arm. As can be seen in FIGS. 10 and 11, the tensioning member (100), which can be releasably coupled to the support frame (12), can rotate about a hinged coupling utilizing the ball end (102) and socket (20) to create the hinged coupling. The fact that the tensioning member is releasable is an important feature and improvement over some systems in that it facilitates replacement of an old flexible material with a new flexible material.

From the engaged position, the tensioning member can be partially moved. This can be accomplished through a partial rotation of the lever arm, for example, about the hinged coupling. As can be seen in FIGS. 9, 10, and 11, this rotation of the tensioning member can force the spring arm (30) into a flexed position. This can specifically be seen in FIG. 10 where the solid line designates the flexed position and the dashed line represents the normal unflexed position. Furthermore, rotation of the lever arm is shown via the arced arrows in FIG. 10. As the lever arm is partially rotated about socket (20) via ball end (108), the cam (102) is forced against the surface of the material retainer (70). The cam engages the shoulder of the projecting face (74) of the material retainer and pushes the material retainer along the sliding surface of the vertical member (46) of the support frame (12). As the lever arm continues to rotate, the material retainer is pushed further along the main vertical member (46). Due to the shape of the tensioning member, the spring arm is relaxed towards its unflexed position. In doing so, the spring arm can exert a force against the tensioning member and can force it even further in the direction in which the lever arm is rotated. This feature allows the system to accomplish the act of self-tensioning in that the user need only start the tensioning member in motion while the spring can supply the force to complete the task. In this fashion, the system accomplishes self-tensioning by supplying the tensioning force itself. By forcing the tensioning member against the material retainer, the material retainer can be forced along the main vertical member (46) of the support frame (12), as well as secured against the support frame. Therefore, this system can accomplish tensioning, as well as releasable coupling of the material retainer to the support frame. In this fashion, the flexible sheet of material is consequently tensioned and coupled to the support frame.

In rotating the tensioning member from an engaged position through its final closed position as shown in FIG. 11, one rotates tensioning member (100) through a range of positions. This is demonstrated in part by the arced range of motion shown in FIGS. 10 and 11. Through the use of a beveled edge on the cam surface (102), one can establish an intermediate position in which the tensioning member can be established in a stationary position, as shown in FIG. 20. In this manner, the material retainer can be secured to the support frame; yet, the material retainer can be established in a position that permits one to add or remove a poster (5) or other type of sign material on top of the retained flexible sheet of material (4). This can be seen through FIGS. 20 and 21. This is a key feature in that it allows one to use this system not only to tension and secure a back lit translucent sheet of material, yet, it also allows one to add an overlay sign that goes on top of the translucent sheet of material and is retained by the tensioning member, for example by an end portion of the tensioning member. This can be seen in FIG. 21 in which the end portion of the tensioning member is configured to clamp or retain the the second piece of material against the tensioned flexible sheet of material and the support frame. It is also envisioned that the material retainer could have enough length that the end portion of the tensioning member clamps the second piece of material against the flexible sheet of material and the material retainer. Therefore, the intermediate position facilitates the insertion of a display sign over a translucent sheet of material. Furthermore, the intermediate position prevents one from marring the surface of the frame by not requiring one to open the frame to the position where the tensioning member is disengageable. A nicely painted sign frame might be marred by the tensioning member being opened to such a position.

The system permits pushing the sheet of material coupled to the material retainer a predetermined distance. This is an important feature in that it allows one to design a sign system, for example, in advance of its installation and ensure that the sign system will be properly tensioned when it is erected in the field. Such a predetermined distance might be critical when the type of material being used is of a type that cannot be tensioned or stretched more than a certain amount without damaging the material, as is the case in the use of PANAFLEX™ 600/645 GPS Series material developed by 3M. With this type of material, one needs to be sure not to tension it too much or else risk damaging the material. Therefore, this predetermined distance is not just some distance that occurs, it is rather a preselected distance for the type of sheet of material being erected. Furthermore, the sheet of material may be pushed along the support surface of the support frame or it may be pushed over some other physical arrangement to produce the predetermined amount of tension. In the present system, this can be accomplished via pushing the material retainer which engages the flexible sheet of material along the main vertical member (46) of the support frame (12).

A substantial portion of at least one edge of the material can be simultaneously tensioned with this system. This is accomplished by exerting a force against a material retainer which engages a substantial portion of an edge of the flexible sheet of material. The material retainer is then pushed a predetermined distance and the flexible sheet of material is consequently pushed a similar distance regardless of the coefficient of friction of the material being tensioned.

As the material retainer is urged along the support frame, the material retainer is established in a releasable secured position with the support frame. This releasable secured position also can be viewed as a releasable locked engagement with the support frame. It would typically take an intentional force by the user or a substantial external force, such as a wind force to open the tensioning member and release the releasably secured material retainer from this position. Again, in this fashion, the material retainer is releasably coupled to the support frame. Furthermore, the material retainer is established in a tensioned position.

As the tensioning member is rotated about the axis of rotation of the coupling toward a closed position, it is capable of generating an audible indication when the flexible sheet of material has been established in its tensioned position. This is accomplished by producing an audible indication, such as a "snapping" sound, when the tensioning member is forcefully moved into contact with either the material retainer, the flexible sheet of material, or indirectly to the support frame via the flexible sheet of material. Such an audible indication can be a predetermined audible indication based on factors such as spring force, surfaces used to contact one another, or other factors known by those of ordinary skill in the art. One manner of producing such an audible indication is via the flat surface of tensioning member (120) forcefully engaging or contacting the substantially flat surface of the material retainer (70). Another is via surface (140) of the tensioning member indirectly contacting support frame (12) as shown in FIG. 11. Once the material retainer is established in its tensioned position, it can then be held in place. This is accomplished via holding the material retainer in releasably locked engagement with the support frame. In this fashion the material retainer is secured or locked releasably to the support frame.

As can be seen in FIG. 11, the tensioning member can serve to cover or conceal the material retainer which has been established in its tensioned position. In this fashion, the tensioning member (100) can serve not only to tension the sign face, it also can serve as a covering for part of the exterior frame of the frame system by hiding the material retainer as well as other portions of the frame interior (42). In addition, the spring arm can serve a similar function of hiding a portion of the material retainer as well the interior frame area (42). Again, this is unique in that the spring arm and tensioning member are serving dual roles as coupling elements as well as covering or concealing elements. In this fashion, the spring arm and the tensioning member serve as part of the exterior surface of the support frame.

A key feature of the system is the fact that it not only allows tensioning of a flexible sheet of material (4), but it also provides a retention system for a second sheet of material (5) to be placed over a portion of the first sheet of material. This can be seen in FIG. 21 where a flexible sheet of material is tensioned to provide a backing for a sign to be positioned on top of the flexible sheet of material. This arrangement can be utilized at point of purchase-type applications where one desires to use several different signs during the year, month, season or day. In this fashion, different signs can be used on the same sign frame and same backing yet varying messages or graphic images can be conveyed by the different signs laid on top of the flexible sheet of material. The system will tension the flexible sheet of material used as backing and will also retain the current sign or image of choice. Furthermore, the intermediate position of the tensioning member can facilitate the removal of the sign of choice and replacement with the new sign of choice.

Several embodiments of material retainers are shown in FIGS. 2, 12, 13, 14 and 15. As can be seen with reference to FIG. 12, one such material retainer (200) can be comprised of a sliding surface (204), adhesion surface (208), force contact surface (212) and a projecting face (216). The sliding surface allows the material retainer to move along a support surface, such as a support frame. Typically, the support surface and sliding surface will be substantially planar to the extent that their surfaces allow movement of the surfaces in the direction that establishes the flexible sheet of material in tension. The adhesion surface (208) can be utilized to position the flexible sheet of material in its proper alignment on the material retainer (200). This adhesion can also assist in retaining the flexible sheet of material to the material retainer (200). One method of adhesively coupling PANAFLEX™ 600/645 GPS Series material is via an adhesive tape. Use of this tape allows one to adhesively couple or position the sheet of material on the material retainer (200). The force contact surface can be configured to receive a propelling force capable of propelling the material retainer along a support surface. Such a force contact surface can be comprised of a projecting face (216) as shown in FIG. 12. This projecting face as understood from the earlier discussion, can be used to engage a cam from a tensioning member in order to be pushed along by the tensioning member. In the present embodiment shown in FIG. 12, the projecting face is disposed opposite from the adhesion surface. However, it should be understood that the adhesion surface and projecting face may be on the same side or different sides. The material retainer (200) can have continuous length in order to allow it to engage a substantial portion of a single edge of a flexible sheet of material.

In operation, a material retainer is typically first provided by the user to retain the flexible sheet of material. The flexible sheet of material can be laid over the top of the material retainer and adhesively coupled to at least one surface of the material retainer as shown in FIG. 12. As a result, the flexible sheet of material can be wrapped across the top surface of the material retainer and over the projecting face of the material retainer. Again, it should be understood that the adhesive coupling surface could be on the opposite edge without the need to overlap the projecting face.

An alternative material retainer (300) is shown in FIG. 13. This material retainer can utilize interlocking members to clamp or secure the flexible sheet of material. A first interlocking member (310) is shown in FIG. 13 having a top end (312), a bottom end (314), a material-engaging side (316), as well as an opposing side (317). This first interlocking member can have a projecting surface (318) at the top for interlocking with a second interlocking member (320). Similarly, second interlocking member (320) is shown with a top end (322) a bottom end (324) and a material-engaging side (326). In addition, second interlocking member (320) can have an opposing side (327) which is opposite from the material-engaging side (326). An overlapping surface (328) can overlap the projecting surface (318) of the first interlocking member. The interlocking of the first and second interlocking member can provide a projecting surface (329) for engagement by the tensioning member (100). This projecting surface (329) can have a base (330) and a shoulder (78).

This material retainer (300) can be an independent device that exists independently from the support frame. It can be configured to engage the flexible sheet of material independent from the support frame as well as retain it independent from the support frame. This can facilitate manipulation of the flexible sheet of material for positioning on the support frame. The material-engaging side of each interlocking member can run from the top to the bottom end of each member so that at least a portion of the material is clamped. The projecting surface (318) at the top of the first interlocking member can be shaped for insertion into the overlapping surface (328) of the second interlocking member. Such a shape facilitates the interlocking of the two pieces. The second interlocking member can be independent not only from the support frame but also independent from the first interlocking member. Therefore, the two pieces can be separable. This helps facilitate the clamping of the material between the two pieces, as there is no coupling to interfere with the establishment of the flexible sheet of material between the two pieces. The two interlocking members can be shaped to releasably interlock with one another when the flexible sheet of material is disposed or positioned between them. Furthermore, the second interlocking member can comprise a sliding surface which is configured to slide along the support frame.

The overlapping surface at the top of the second interlocking member can be shaped or configured to overlap the projecting surface (318) of the first interlocking member. In doing so, this overlap can define a projecting face (74) which can be shaped or sized for pushing by a cam or other device. Not only can a projecting face be provided, but a shoulder (78) of the face and a base at that face can be provided as well. A substantially planar surface (332) can run from the base (330) to the bottom of the second interlocking member. The interlocking of the first and second interlocking members can be accomplished such that a flexible sheet of material is retained between the material-engaging side of the first interlocking member and the material-engaging side of the second interlocking member. The projecting face which is provided when the first interlocking member and the second interlocking member are interlocked can be shaped or configured so as to be pushed by a tensioning member. The projecting face can have a shoulder which can be shaped or configured for receiving the cam of the tensioning member.

To position the loose end or marginal edge of the flexible sheet of material a retainer can be used. Such a retainer can be used to initially position the material or it can also be used to simply retain the material. For example, a groove (405) as shown in FIG. 13 might be used to position the material by lining up the groove with a marking or hole on the material. Similarly, a protrusion or projection on one of the interlocking members can be utilized. For example, a projection at the top of the first interlocking member could be used should the flexible sheet of material have a hole to align with such a projection. Finally, one of the interlocking members could utilize an adhesion surface to position the flexible sheet of material via some type of adhesion device.

Figure 14:
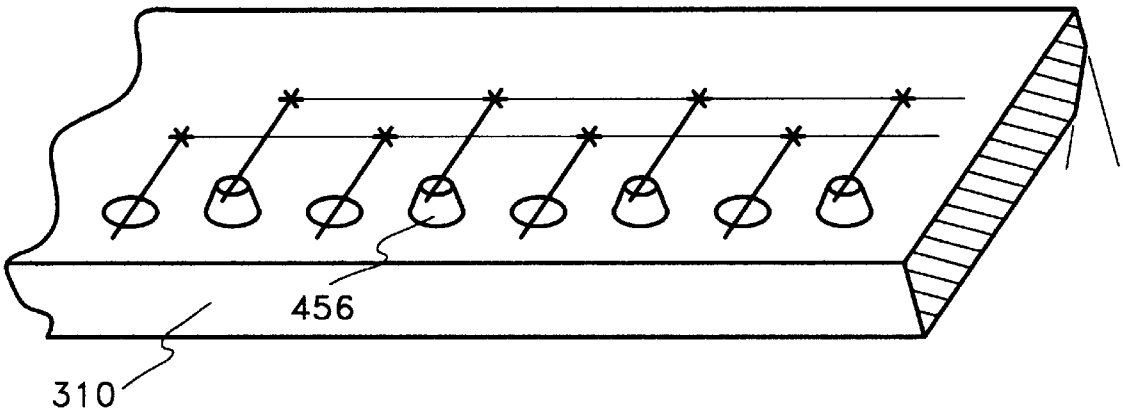
FIG. 14 shows a portion of a material retainer having projections used for retaining or positioning a flexible sheet of material that has alignment holes.
Figure 15:
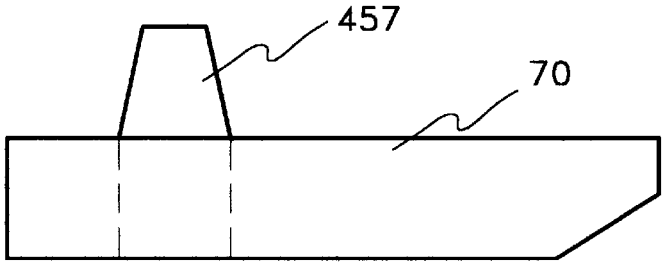
FIG. 15 shows in section view the alternative material retainer of FIG. 14 having a beveled edge as well as a projection to engage a hole in the flexible sheet of material.

For flexible sheets of material that are provided with holes similar to tractor feeds, as seen in computer printout paper, projections or protrusions can be established along the material retainer to couple the flexible sheet of material to the retainer. For example, FIG. 14 shows a cut away view of a part of a material retainer having holes and projections for engaging a flexible sheet of material with tractor feed holes to serve as a tractor feed retainer. For example, if such a system were utilized with the material retainer (300), holes and projections might be used alternatively on each material-engaging side of the first and second interlocking members. In this fashion, holes of the first interlocking member would engage projections (457) on the second interlocking member and similarly projections (456) of the first interlocking member could engage the second interlocking member. The flexible sheet of material with tractor feed holes would be disposed between the two interlocking members such that the projections were inserted through the holes in the flexible sheet of material. Other applications of such tractor feed projections can be envisioned for other material retainers as well. FIG. 2 shows a third alternative material retainer in which a flexible sheet of material is entrapped between two pieces of a material retainer (70). Again, a projecting face (74) can be utilized in this version of the material retainer.

To utilize the material retainer shown in FIG. 13, one need first provide a first interlocking member for engagement with at least a portion of the flexible sheet of material. A second interlocking member should also be provided to establish a clamp with the first interlocking member, as discussed below. The flexible sheet of material can be established between the first interlocking member and the second interlocking member. The loose end (7) of the flexible sheet of material can be positioned along the material retainer such that the flexible sheet of material is positioned properly to accomplish the desired amount of tension. A groove can be utilized to retain or position the loose end on the material retainer. Or, a protrusion or projection can be utilized to position or retain the loose end of the flexible sheet of material. This is particularly useful if the flexible sheet of material has a hole for alignment with the projection. Next, the first interlocking member and second interlocking member can be releasably interlocked with one another. For example, a male piece of the first interlocking member can be inserted or combined with a female piece on the second interlocking member. In this fashion, the flexible sheet of material can be retained between the first interlocking member and the second interlocking member due to the clamping force between the two pieces and the snug fit produced by the interlocking of the two pieces. Furthermore, the clamping aspect can be combined with an adhesion step in order to adhesively couple the flexible sheet of material to one of the interlocking members. This can be envisioned with reference to FIG. 13. As a result of the interlocking of the two pieces, the flexible sheet of material can be retained and a projecting face provided for coupling with the cam of tensioning member (100). It may be possible to secure just a portion of the flexible sheet of material between the first and second interlocking members rather than extending the flexible sheet of material all the way from the top to the bottom of the interlocking members. Finally, a sliding surface shaped or configured to slide along the support frame can be provided by the interlocking of the first and second interlocking members. This can be visualized by FIGS. 8 through 11 in which this type of material retainer slides along the main vertical member (46) of the support frame (12).

Figure 16:
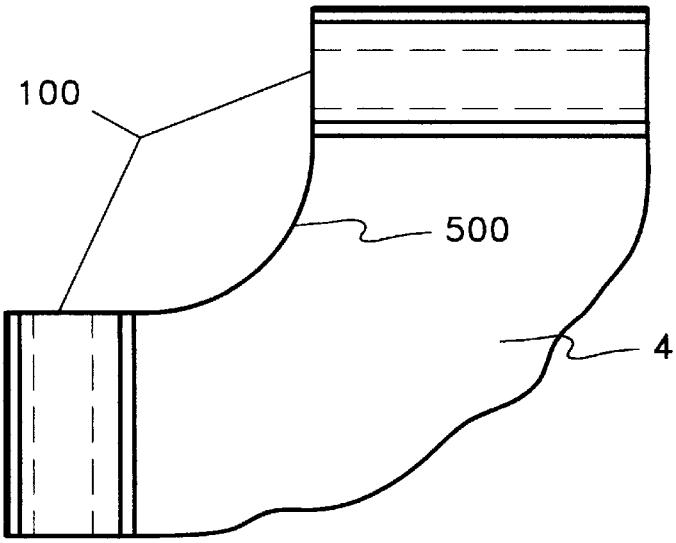
FIG. 16 shows a flexible sheet of material with a corner arcuately cut away to reduce the chance of tearing the flexible sheet of material.

While the above description describes a specific application of a material retainer to a single side of a flexible sheet of material, it is envisioned that a material retainer can be utilized on a plurality of sides of a flexible sheet of material. For example, typically a sign system will utilize a four-sided sign. The present system allows the user to engage each side of the sign with a material retainer. It is preferable to trim the corners of the flexible sheet of material once the material retainers have been established on each edge of the sign. In using a substrate material which has a tendency to rip or tear, it is preferable to make a radius arc cut starting from one edge of the material retainer and radially cutting the arc to the other edge of the neighboring material retainer. The arcuate cut can be seen by reference to FIG. 16 in which the tensioning members (100) are shown and the arcuate cut (500) is shown as well. An Exacto knife or scissors can be used to accomplish this. This cut is important in order to avoid tearing or ripping of the material which tends to occur when sharp corners are utilized. Then, the material retainers can be established in their pre-tension positions in the frame. Next, the tensioning member (100) for each side can be established in its engaged position as shown in FIG. 9. As noted earlier, the tensioning member should provide an audible indication when it is established in its correct position. Then, the tensioning members can be secured in their closed positions in order to secure the flexible sheet of material in a tensioned and/or retained position. For some types of material it is necessary to stretch the face in one direction before applying tension in the second direction. For example, with a rectangular sign and the use of 3M's PANAFLEX™ 600/645 GPS Series material, one can first tension the material in a longitudinal direction and then release it. Next, one should tension the top and bottom and leave those tensioning members in place. Finally, the tensioning members which previously were used to prestretch in the longitudinal direction should again be closed.

Figure 24:
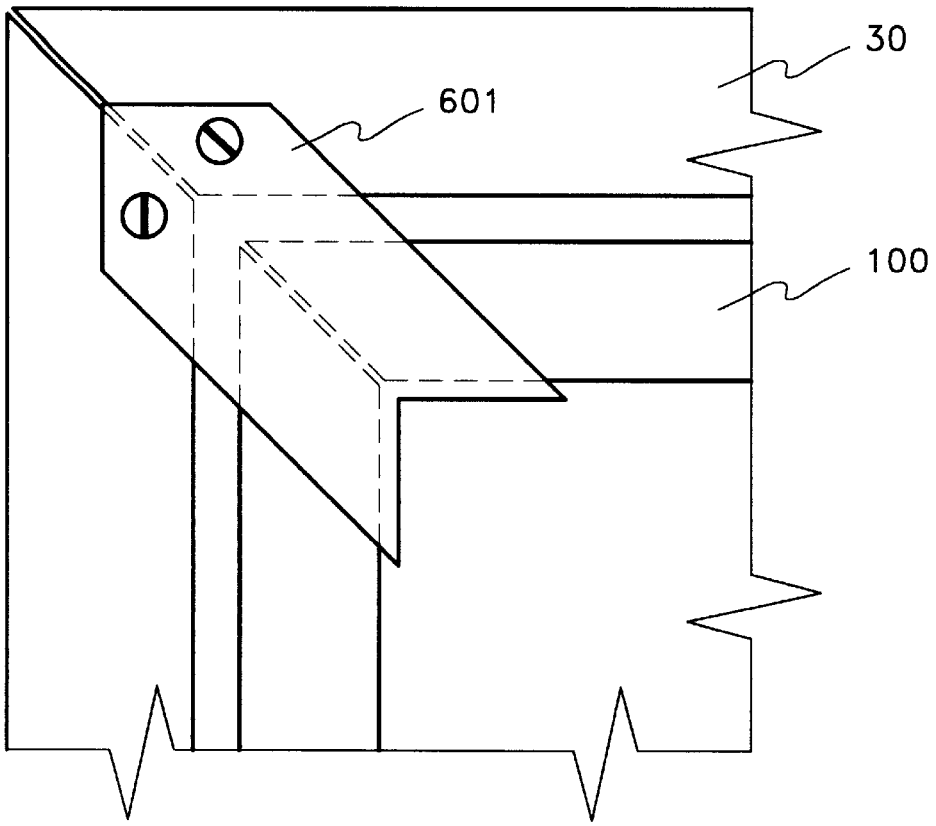
FIG. 24 shows a side view of the fastener shown in FIG. 23.
Figure 23:
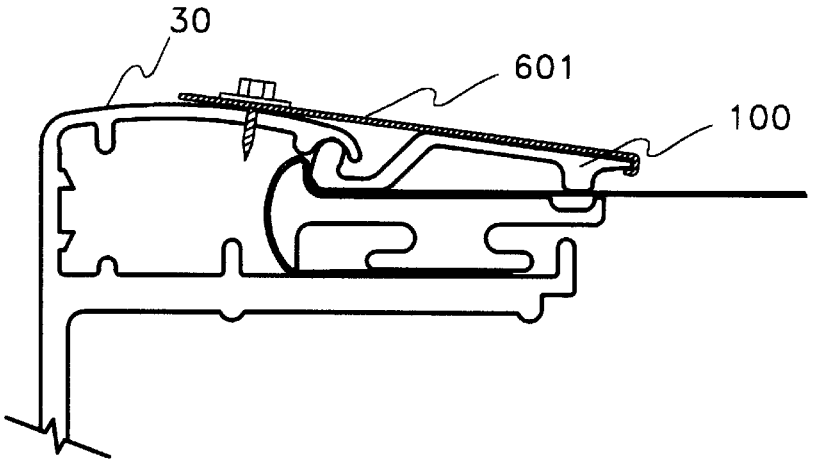
FIG. 23 shows a fastener used to secure two tensioning members in their closed positions.

For use of this system in high winds, fasteners can be added to hold the tensioning members in place. For example, this might involve the use of a clip (601) at the corner where two different tensioning members meet, as shown in FIGS. 23 and 24. By securing all four corners of a four corner sign, one could prevent the tensioning member from being forced open under the high wind load. Similarly, other equivalent fasteners could be envisioned as well.

Naturally, in the above description as well as the claims that follow, those terms indicating orientation or position (e.g., vertical, top, bottom, etc.) are merely used in reference to the drawings and are not intended to have their typical definitions or to limit the claims; they merely connote different features of the elements and should be interpreted in view of the description and drawings.

The foregoing discussion and the claims that follow describe the preferred embodiments of the present invention. Particularly with respect to the claims it should be understood that changes may be made without departing from the essence of the invention. In this regard, it is intended that such changes would still fall within the scope of the present invention. It is simply not practical to describe and claim all possible revisions which may be accomplished. To the extent such revisions utilize the essence of the present invention, each naturally falls within the breadth of protection encompassed by this patent. This is particularly true for the present invention since its basic concepts and understandings are fundamental in nature and can be applied broadly in a variety of ways. Further, it should be understood that various permutations and combinations of the elements shown in the claims are possible and should fall within the scope of this disclosure.

What is claimed is:

1. A sign apparatus to apply tension to a flexible sheet of material, the apparatus comprising:

at least one support frame having an integral spring arm sized to support the flexible sheet of material;

at least one independent material retainer having a projecting face having a shoulder surface independent from the at least one support frame and capable of retaining the flexible sheet of material independent from the at least one support frame, the projecting face of the at least one independent material retainer configured to assist in tensioning the flexible sheet of material and wherein said integral spring arm biases toward the at least one independent material retainer;

a hinged coupling; and at least one tensioning member hingeably coupled to the support frame via the hinged coupling wherein said tensioning member engages the projecting face having a shoulder surface of the at least one independent material retainer to move the at least one independent material retainer in a direction which tensions the flexible sheet of material when the at least one tensioning member is at least partially moved about the hinged coupling.

2. The sign apparatus to apply tension to a flexible sheet of material as described in claim 1 and wherein the at least one tensioning member holds the at least one independent material retainer in releasably secured engagement with the at least one support frame.

3. The sign apparatus to apply tension to a flexible sheet of material as described in claim 1 wherein the at least one tensioning member comprises a cam and a lever arm.

4. The sign apparatus to apply tension to a flexible sheet of material as described in claim 3 wherein the lever arm is shaped to force the cam against the at least one independent material retainer when the lever arm is partially rotated.

5. The sign apparatus to apply tension to a flexible sheet of material as described in claim 3 wherein the at least one independent material retainer having a projecting face further comprises a shoulder surface which is shaped to engage with the cam.

6. The sign apparatus to apply tension to a flexible sheet of material as described in claim 5 wherein the lever arm is shaped to force the cam against the shoulder of the projecting face when the lever arm is partially rotated.

7. The sign apparatus to apply tension to a flexible sheet of material as described in claim 5 wherein the at least one tensioning member further comprises a ball end and wherein the at least one support frame further comprises a socket, and wherein the ball end is at least partially rotatable within the socket.

8. The sign apparatus to apply tension to a flexible sheet of material as described in claim 7 wherein the ball end is responsive to the lever arm such that the ball end is partially rotatable within the socket of the at least one support frame and wherein the cam is responsive to the lever arm such that the cam is forced against the shoulder of the at least one independent material retainer to accomplish pushing of the at least one independent material retainer.

9. The sign apparatus to apply tension to a flexible sheet of material as described in claim 8 wherein the cam comprises a beveled edge and wherein the at least one tensioning member is responsive to the beveled edge of the cam so as to be established in a stationary position via the beveled edge of the cam.

10. The sign apparatus to apply tension to a flexible sheet of material as described in claim 1 wherein the at least one tensioning member comprises a ball end and wherein the at least one support frame comprises a socket and wherein the hinged coupling comprises the ball end and socket.

11. The sign apparatus to apply tension to a flexible sheet of material as described in claim 10 wherein the integral spring arm comprises extruded aluminum.

12. The sign apparatus to apply tension to a flexible sheet of material as described in claim 1 wherein the at least one tensioning member flexes the integral spring arm.

13. The sign apparatus to apply tension to a flexible sheet of material as described in claim 12 wherein the integral spring arm forces the at least one tensioning member through a partial rotation to accomplish self tensioning of the flexible sheet of material.

14. The sign apparatus to apply tension to a flexible sheet of material as described in claim 13 wherein the at least one tensioning member comprises a flat face and wherein the integral spring arm secures the flat face against the at least one independent material retainer.

15. The sign apparatus to apply tension to a flexible sheet of material as described in claim 1 wherein the integral spring arm comprises a socket at a distal end.

16. The sign apparatus to apply tension to a flexible sheet of material as described in claim 1 wherein the at least one support frame comprises an exterior surface and wherein the integral spring arm forms part of the exterior surface.

17. The sign apparatus to apply tension to a flexible sheet of material as described in claim 1 wherein the at least one support frame comprises an exterior surface and wherein the at least one tensioning member serves as part of the exterior surface.

18. The sign apparatus to apply tension to a flexible sheet of material as described in claim 1 wherein the at least one support frame comprises a material retainer support shaped to support the at least one independent material retainer in a pre-tensioned position.

19. The sign apparatus to apply tension to a flexible sheet of material as described in claim 18 wherein the material retainer support comprises a flange.

20. The sign apparatus to apply tension to a flexible sheet of material as described in claim 19 wherein the flange supports the at least one independent material retainer in a pre-tensioned position.

21. The sign apparatus to apply tension to a flexible sheet of material as described in claim 1 wherein the at least one support frame comprises a main vertical member.

22. The sign apparatus to apply tension to a flexible sheet of material as described in claim 21 wherein the at least one independent material retainer is configured to move along the main vertical member.

23. The sign apparatus to apply tension to a flexible sheet of material as described in claim 22 wherein the at least one independent material retainer comprises a substantially planar sliding surface.

24. The sign apparatus to apply tension to a flexible sheet of material as described in claim 23 wherein the main vertical member comprises a substantially planar sliding surface and wherein the substantially planar sliding surface of the at least one independent material retainer slides along the substantially planar sliding surface of the main vertical member.

25. The sign apparatus to apply tension to a flexible sheet of material as described in claim 1 wherein the flexible sheet of material comprises a plurality of edges and wherein the at least one independent material retainer engages a substantial portion of at least one edge of the flexible sheet of material.

26. The sign apparatus to apply tension to a flexible sheet of material as described in claim 25 wherein a substantial portion of at least one edge comprises an entire edge.

27. The sign apparatus to apply tension to a flexible sheet of material as described in claim 1 wherein the at least one tensioning member pushes the at least one independent material retainer a predetermined distance.

28. The sign apparatus to apply tension to a flexible sheet of material as described in claim 1 wherein the at least one tensioning member is rotatable from an open position to a closed position and wherein the at least one tensioning member accomplishes a predetermined amount of tension in moving from the open position to the closed position.

29. The sign apparatus to couple a flexible sheet of material to a support frame as described in claim 28 wherein the at least one support frame has a frame interior and wherein the integral spring arm covers at least a part of the frame interior.

30. A sign system method of applying tension to a flexible sheet of material, the method comprising the steps of:

providing at least one support frame having an integral spring arm sized to support the flexible sheet of material;

retaining a portion of the flexible sheet of material independent from the at least one support frame with at least one independent material retainer having a projecting face;

coupling at least one tensioning member to the at least one support frame via a hinged coupling;

biasing the at least one tensioning member toward the at least one independent material retainer through the action of the integral spring arm;

partially moving the at least one tensioning member about the hinged coupling; and pushing the projecting face of the at least one independent material retainer to move the at least one independent material retainer in a direction which tensions the flexible sheet of material.

31. The sign system method of applying tension to a flexible sheet of material as described in claim 30 and further comprising the step of holding the at least one independent material retainer in releasably secured engagement with the at least one support frame.

32. The sign system method of applying tension to a flexible sheet of material as described in claim 30 wherein the at least one tensioning member comprises a cam and a lever arm and further comprising the step of forcing the lever arm so that the cam is forced against the at least one independent material retainer.

33. The sign system method of applying tension to a flexible sheet of material as described in claim 32 and further comprising the step of partially rotating the lever arm to force the cam against the at least one independent material retainer.

34. The sign system method of applying tension to a flexible sheet of material as described in claim 33 wherein the step of forcing the cam against the projecting face when the lever arm is partially rotated pushes the projecting face to move the at least one independent material retainer.

35. The sign system method of applying tension to a flexible sheet of material as described in claim 34 wherein the at least one tensioning member comprises a ball end and wherein the at least one integral spring arm of the support frame comprises a socket and further comprising the step of partially rotating the ball end within the socket.

36. The sign system method of applying tension to a flexible sheet of material as described in claim 35 and further comprising the step of forcing the ball end to partially rotate via the lever arm.

37. The sign system method of applying tension to a flexible sheet of material as described in claim 30 wherein the at least one tensioning member comprises a ball end and wherein the frame comprises a socket and wherein the step of coupling comprises utilizing the ball end and socket to form a hinged coupling.

38. The sign system method of applying tension to a flexible sheet of material as described in claim 30 and further comprising the step of utilizing a tensioning member to force the integral spring arm into the flexed position.

39. The sign system method of applying tension to a flexible sheet of material as described in claim 38 and further comprising the step of partially rotating the at least one tensioning member to accomplish self-tensioning of the flexible material.

40. The sign system method of applying tension to a flexible sheet of material as described in claim 30 and further comprising the step of securing the at least one tensioning member against the at least one independent material retainer.

41. The sign system method of applying tension to a flexible sheet of material as described in claim 30 and further comprising the step of covering the at least one independent material retainer with the integral spring arm.

42. The sign system method of applying tension to a flexible sheet of material as described in claim 30 and further comprising the step of covering the at least one independent material retainer with the at least one tensioning member.

43. The sign system method of applying tension to a flexible sheet of material as described in claim 30 and further comprising the step of supporting the at least one independent material retainer in a pre-tensioned position.

44. The sign system method of applying tension to a flexible sheet of material as described in claim 43 and further comprising the step of supporting the at least one independent material retainer on a support flange.

45. The sign system method of applying tension to a flexible sheet of material as described in claim 30 and further comprising the step of pushing the at least one independent material retainer along a main vertical member of the at least one support frame.

46. The sign system method of applying tension to a flexible sheet of material as described in claim 30 wherein the flexible sheet of material comprises a plurality of edges, and further comprising the step of engaging a substantial portion of at least one edge with the at least one independent material retainer.

47. The sign system method of applying tension to a flexible sheet of material as described in claim 46 and further comprising the step of engaging the entire edge with the at least one independent material retainer.

48. The sign system method of applying tension to a flexible sheet of material as described in claim 46 and further comprising the step of simultaneously tensioning a substantial portion of at least one edge of the flexible sheet of material.

49. The sign system method of applying tension to a flexible sheet of material as described in claim 30 and further comprising the step of pushing the at least one independent material retainer a predetermined distance.

50. The sign system method of applying tension to a flexible sheet of material as described in claim 49 and further comprising the step of applying a predetermined amount of tension to the flexible sheet of material.

51. The sign system method of applying tension to a flexible sheet of material as described in claim 32 and further comprising the step of rotating the at least one tensioning member from an open position to a closed position.

52. A sign apparatus to apply tension to a flexible sheet of material, the apparatus comprising:

at least one support frame having an integral spring arm and sized to support the flexible sheet of material;

at least one independent material retainer, independent from the at least one support frame and capable of retaining the flexible sheet of material independent from the at least one support frame, and wherein said at least one independent material retainer has a projecting face having a shoulder surface;

a hinged coupling;

an axis of rotation of the hinged coupling; and at least one tensioning member hingeably coupled to the integral spring arm of the at least one support frame via the hinged coupling configured to releasably secure the at least one tensioning member whereby the integral spring arm biases the at least one tensioning member toward the independent material retainer and wherein the at least one tensioning member engages the projecting face having a shoulder surface of the at least one independent material retainer to move the independent material retainer in a direction which tensions the flexible sheet of material when the at least one tensioning member is at least partially moved about the axis of rotation of the hinged coupling.

53. The sign apparatus to apply tension to a flexible sheet of material as described in claim 52 wherein the at least one tensioning member comprises a lever arm and a cam, wherein the lever arm is shaped to rotate about the at least one support frame to force the cam against the projecting face of of the at least one independent material retainer so as to push the projecting face and thereby move the at least one independent material retainer and tension the flexible sheet of material.

54. The sign apparatus to apply tension to a flexible sheet of material as described in claim 53 wherein the integral spring arm comprises a socket located at a distal end of the integral spring arm and wherein the at least one tensioning member comprises a ball end sized for insertion into the socket, the hinged coupling comprising the ball end and socket such that the at least one tensioning member is at least partially rotatable about the socket.

55. The sign apparatus to apply tension to a flexible sheet of material as described in claim 52 wherein the flexible sheet of material has an edge and wherein the hinged coupling comprises a continuous hinged coupling to hingeably couple the edge of the flexible sheet of material.

56. A sign system method of applying tension to a flexible sheet of material, the method comprising the steps of:

providing a support frame having an integral spring arm to support the flexible sheet of material;

retaining a portion of the flexible sheet of material independent from the at least one support frame with at least one independent material retainer, the at least one independent material retainer having a projecting face;

positioning the at least one independent material retainer in a pre-tension position on the at least one support frame;

coupling the at least one tensioning member to the at least one support frame via a hinged coupling, the at least one tensioning member comprising a cam and a lever arm;

biasing the at least one tensioning member toward the at least independent material retainer through the action of the integral spring arm;

partially rotating the lever arm of the at least one tensioning member about the hinged coupling;

pushing the projecting face of the at least one independent material retainer via the cam to move the independent material retainer so as to tension the flexible sheet of material.

57. The sign system method of applying tension to a flexible sheet of material as described in claim 56 wherein the at least one support frame has a flange and wherein the step of positioning the at least one independent material retainer in a pre-tensioned position comprises the step of supporting the at least one independent material retainer by the flange.

58. The sign system method of applying tension to a flexible sheet of material as described in claim 56 and further comprising the step of engaging a substantial portion of at least one edge of the flexible sheet of material so as to simultaneously tension an entire side of the flexible sheet of material.

59. The sign system method of applying tension to a flexible sheet of material as described in claim 56 and further comprising the step of indicating via an audible indication when the flexible sheet of material has been established in the tensioned position.

60. The sign system method of applying tension to a flexible sheet of material as described in claim 59 wherein the step of partially rotating the lever arm of the at least one tensioning member about the hinged coupling comprises the step of flexing the integral spring arm.

61. The sign system method of applying tension to a flexible sheet of material as described in claim 60 and further comprising the steps of:

inserting the at least one independent material retainer into the at least one support frame; and then engaging the at least one support frame with the at least one tensioning member to couple the at least one tensioning member to the at least one support frame.

62. A sign apparatus to retain a flexible sheet of material and a second piece of material, the apparatus comprising:

at least one support frame having an integral spring arm sized to support the flexible sheet of material and the second piece of material;

at least one independent material retainer independent from the at least one support frame and capable of retaining the flexible sheet of material independent from the at least one support frame, wherein the at least one independent material retainer has a projecting face having a shoulder surface configured to assist in tensioning the flexible sheet of material and wherein said integral spring arm biases toward the at least one independent material retainer;

a hinged coupling;

at least one tensioning member hingeably coupled to the of the at least one support frame via the hinged coupling, wherein the at least one tensioning member engages the projecting face having a shoulder surface of the at least one independent material retainer to move the independent material retainer in a direction which tensions the flexible sheet of material when the at least one tensioning member is at least partially moved about the hinged coupling; and an end portion of the at least one tensioning member configured to retain the second piece of material.

63. The sign apparatus to retain a flexible sheet of material and a second piece of material as described in claim 62 wherein the end portion of the at least one tensioning member retains the second piece of material against the flexible sheet of material.

64. The sign apparatus to retain a flexible sheet of material and a second piece of material as described in claim 62 wherein the end portion of the at least one tensioning member retains the second piece of material by clamping the second piece of material between the end portion of the at least one tensioning member and the at least one support frame.

65. The sign apparatus to retain a flexible sheet of material and a second piece of material as described in claim 62 wherein the end portion of the at least one tensioning member retains the second piece of material by clamping the second piece of material between the end portion of the at least one tensioning member and the at least one independent material retainer.

66. A sign system method to retain a flexible sheet of material and a second piece of material, the method comprising the steps of:

providing a support frame having an integral spring arm sized to support the flexible sheet of material;

retaining a portion of the flexible sheet of material independent from the at least one support frame with at least one independent material retainer having a projecting face;

coupling at least one tensioning member to the at least one support frame via a hinged coupling;

biasing the at least one tensioning member toward the at least one independent material retainer through the action of the integral spring arm;

partially moving the at least one tensioning member about the hinged coupling;

pushing the projecting face of the at least one independent material retainer to move the at least one independent material retainer in a direction which tensions the flexible sheet of material; and utilizing the at least one tensioning member to retain a portion of the second piece of material.

67. The sign system method to retain a flexible sheet of material and a second piece of material as described in claim 66 wherein the step of utilizing the at least one tensioning member to retain a portion of the second piece of material comprises clamping the second piece of material with the at least one tensioning member.

68. The sign system method to retain a flexible sheet of material and a second piece of material as described in claim 67 wherein the step of clamping further comprises clamping the second piece of material between the at least one tensioning member and the flexible sheet of material.

69. The sign system method to retain a flexible sheet of material and a second piece of material as described in claim 67 wherein the step of clamping further comprises clamping the second piece of material between the at least one tensioning member and the at least one independent material retainer.

70. The sign system method to retain a flexible sheet of material and a second piece of material as described in claim 67 wherein the step of clamping further comprises clamping the second piece of material between the at least one tensioning member and the at least one support frame.

* * * * *